US008437676B2

(12) United States Patent
Tanaka et al.

(10) Patent No.: US 8,437,676 B2
(45) Date of Patent: May 7, 2013

(54) IMAGE-BEARING MEMBER PROTECTING AGENT, METHOD OF APPLYING AN IMAGE-BEARING MEMBER PROTECTING AGENT, PROTECTIVE LAYER FORMING DEVICE, IMAGE FORMING METHOD, PROCESS CARTRIDGE, AND IMAGE FORMING APPARATUS

(75) Inventors: Shinya Tanaka, Kanagawa (JP); Hiroshi Nakai, Kanagawa (JP); Kunio Hasegawa, Kanagawa (JP); Taichi Urayama, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 307 days.

(21) Appl. No.: 12/801,294

(22) Filed: Jun. 2, 2010

(65) Prior Publication Data

US 2010/0310291 A1 Dec. 9, 2010

(30) Foreign Application Priority Data

Jun. 4, 2009 (JP) ..... 2009-135127

(51) Int. Cl.
*G03G 21/00* (2006.01)

(52) U.S. Cl.
USPC ..... 399/346

(58) Field of Classification Search ..... 399/346, 399/343, 101
See application file for complete search history.

(56) References Cited

U.S. PATENT DOCUMENTS

| | | | | |
|---|---|---|---|---|
| 3,501,294 | A | 3/1970 | Joseph | 430/119.71 |
| 7,653,339 | B2 | 1/2010 | Yamashita | 399/346 |
| 7,833,609 | B2 * | 11/2010 | Fujita et al. | 428/174 |
| 2006/0099016 | A1 | 5/2006 | Watanabe et al. | 399/351 |
| 2006/0285897 | A1 | 12/2006 | Sugiura et al. | 399/346 |
| 2007/0224528 | A1 | 9/2007 | Yamashita | 430/66 |
| 2008/0095553 | A1 | 4/2008 | Tanaka | 399/263 |
| 2008/0138132 | A1 | 6/2008 | Yamashita | 399/343 |
| 2009/0028618 | A1 | 1/2009 | Kabata et al. | 395/346 |
| 2009/0196665 | A1 | 8/2009 | Tanaka et al. | 399/346 |
| 2009/0214238 | A1 | 8/2009 | Tanaka | 399/51 |
| 2009/0279930 | A1 | 11/2009 | Kabata | 399/346 |

(Continued)

FOREIGN PATENT DOCUMENTS

| | | |
|---|---|---|
| JP | 51-22380 | 5/1993 |
| JP | 2001-305907 | 11/2001 |

(Continued)

OTHER PUBLICATIONS

Extended European Search Report dated Apr. 27, 2011 issued in corresponding European Application No. 10164618.0.

*Primary Examiner* — Sophia S Chen

(74) *Attorney, Agent, or Firm* — Harness, Dickey & Pierce, P.L.C.

(57) ABSTRACT

The present invention provides an image-bearing member protecting agent, which has a block shape and is used in an image forming process where the image-bearing member protecting agent is applied or attached to a surface of an image bearing member while being scraped off with a roll-shaped brush, the image-bearing member protecting agent including: a fatty acid metal salt, wherein the image-bearing member protecting agent includes a plurality of small blocks and has such an orientation that one or more of the small blocks are easily separated from other small blocks, and a plurality of oriented surfaces of the plurality of small blocks are arranged in a laminated state in a substantially same direction.

17 Claims, 14 Drawing Sheets

U.S. PATENT DOCUMENTS

| | | | | |
|---|---|---|---|---|
| 2009/0285613 | A1 | 11/2009 | Nakai | 399/346 |
| 2009/0290919 | A1 | 11/2009 | Tanaka | 399/346 |
| 2009/0290920 | A1 | 11/2009 | Hatakeyama | 399/346 |
| 2009/0304423 | A1 | 12/2009 | Ozaki | 399/346 |
| 2009/0311014 | A1 | 12/2009 | Tanaka | 399/315 |
| 2010/0034560 | A1 | 2/2010 | Tanaka | 399/123 |
| 2010/0054829 | A1 | 3/2010 | Iio | 399/346 |
| 2010/0239309 | A1 * | 9/2010 | Tanaka et al. | 399/346 X |

FOREIGN PATENT DOCUMENTS

| | | | |
|---|---|---|---|
| JP | 2007-065100 | | 3/2007 |
| JP | 2007-145993 | A * | 6/2007 |
| JP | 2007-293240 | | 11/2007 |

* cited by examiner

IMAGE-BEARING MEMBER PROTECTING AGENT, METHOD OF APPLYING AN IMAGE-BEARING MEMBER PROTECTING AGENT, PROTECTIVE LAYER FORMING DEVICE, IMAGE FORMING METHOD, PROCESS CARTRIDGE, AND IMAGE FORMING APPARATUS

BACKGROUND OF THE INVENTION

1. Field of the Invention

The present invention relates to an image-bearing member protecting agent for protecting the surface of an image bearing member, a method of applying the image-bearing member protecting agent, a protective layer forming device provided with the image-bearing member protecting agent, an image forming method using the image-bearing member protecting agent, a process cartridge provided with the protective layer forming device, a complex machine provided with the protective layer forming device or the process cartridge, and an image forming apparatus such as a complex machine provided with at least one of a printer, a facsimile and a plotter.

2. Description of the Related Art

Conventionally, in image formation based on an electrophotographic process, an electrostatically charged latent image, i.e., a latent electrostatic image, is formed on an image bearing member formed, for example, of a photoconductive material, and charged toner particles are attached to the latent electrostatic image to form a visible image. The visible image formed of toner is finally transferred onto a transfer medium such as paper, and then fixed on the transfer medium under application of heat, pressure, gas emitted from a solvent, and the like, thereby becoming an output image.

The image forming methods are broadly divided into a so-called two-component developing method in which toner particles and carrier particles are stirred and mixed so as to be frictionally charged as a method of charging the toner particles to form a visible image; and a so-called one-component (single-component) developing method in which a charge is applied to only toner particles, without using carrier particles.

Further, one-component developing methods are classified into a magnetic one-component developing method and a non-magnetic one-component developing method, depending on whether a magnetic force is used to keep toner particles held to a surface of a developing roller.

In image forming apparatuses, such as copiers, complex machines based on the copiers, and the like for which high-speed processability and image reproducibility are required, the two-component developing methods have been employed in many cases due to demands for stable chargeability, of toner particles, stable charge rising properties of the toner particles, long-term stability of image quality, and the like; whereas in compact printers, facsimiles, etc. for which space saving, cost reduction and the like are required, the one-component developing methods have been employed in many cases.

Also, nowadays in particular, the technology of colorization of output images is progressing, and demands for improvement of image quality and stabilization of image quality are increasing like never before.

For the improvement of image quality, toners have been made smaller in average particle diameter, and particles of the toners have been made rounder in shape with their angular parts removed.

Generally, in an image forming apparatus which operates in accordance with any such electrophotographic image forming method, regardless of which developing method is employed, a drum-shaped or belt-shaped image bearing member (typified by a photoconductor) is uniformly charged while being rotated, a latent image pattern is formed on the image bearing member by laser light or the like, and the developing unit creates a visible toner image from the latent image pattern and transfers the toner image onto a recording medium.

After the toner image has been transferred onto the recording medium, untransferred toner components remain on the image bearing member. If such residues are directly conveyed to a region for the charging step, it often hinders the image bearing member from being uniformly charged; accordingly, the toner components, etc. remaining on the image bearing member are generally removed by a cleaning step by a cleaning unit after the transfer step, thereby bringing the surface of the image bearing member into a clean enough state, and then charging is carried out.

Thus, there are various types of physical stress and electrical stress in each step in image formation, which deteriorate the image bearing member, charging member and cleaning member.

In attempts to solve this problem, a number of proposals for lubricants and methods of supplying lubricating components and forming films of lubricating components have been made thus far to reduce deterioration of the image bearing member, charging member and cleaning member.

For example, Japanese Patent Application Publication (JP-B) No. 51-22380 proposes a method of forming a lubricant film on a photoconductor surface by supplying the photoconductor surface with a solid lubricant composed mainly of zinc stearate in order to lengthen the lifespan of photoconductors and cleaning blades. This makes it possible to reduce abrasion of the photoconductor surface and thus lengthen the lifetime of the photoconductor.

Japanese Patent Application Laid-Open (JP-A) No. 2001-305907 proposes a lubricant supplying device as a specific solid lubricant coating method. The lubricant supplying device described in JP-A No. 2001-305907 is provided with a brush roller (a supplying member) which is in contact with a bar-shaped solid lubricant and abrades the solid lubricant so as to supply the scraped fine powder lubricant to a photoconductor belt or an intermediate transfer belt (an object to which the lubricant is supplied).

The solid lubricant is held on a lubricant holding member with which a spring (a spring biasing unit) is contacted. The solid lubricant is pressed toward the brush roller by the biasing force of the lubricant holding member. When the brush roller is driven to rotate, the solid lubricant contacting therewith is abraded, and thus scraped. The lubricant attached on the brush roller is applied onto a surface of the photoconductor belt or intermediate transfer belt.

Further, the lubricant supplying device also includes a lubricant leveling blade. The lubricant leveling blade is provided for spreading the lubricant applied to the photoconductor belt or intermediate transfer belt to form a lubricant layer uniform in thickness thereon.

However, in the configuration where a solid lubricant is pressed against a brush roller with being in contact with a spring, the spring is extended as the solid lubricant is scraped off, and thus the pressing force naturally weakens. As a result, the amount of the solid lubricant scraped is reduced, and the amount of the solid lubricant supplied to a photoconductor or an intermediate transfer belt is also reduced. Therefore, it is impossible to sufficiently protect the photoconductor or intermediate transfer belt.

In an attempt to solve these problems, Japanese Patent Application Laid-Open (JP-A) No. 2007-293240 describes a method in which a movable pressing member is provided in a solid lubricant holding member, and the movable pressing member is pressed against a solid lubricant with a spring member, so that a constant pressing force can be maintained at the solid lubricant as the solid lubricant is scraped off from time to time.

However, it is known that with use of a solid lubricant block obtained by compression molding, it is impossible to prevent a reduction in consumption amount of the solid lubricant block over time even when a constant pressing force is maintained over a period of time (this case will be described hereinbelow in Comparative Examples).

In order to solve this problem, Japanese Patent Application Laid-Open (JP-A) No. 2007-65100 describes that the hardness of the front side of a solid lubricant in its front surface/back surface direction is made higher than that of the back side thereof, so that a reduction in consumption amount of a solid lubricant can be prevented.

However, in the proposal disclosed in JP-A No. 2007-65100, there is no description regarding a method for obtaining a solid lubricant block whose front side and back side are different in hardness.

In addition, JP-A No. 2007-65100 describes that a plurality of solid lubricant blocks having a different hardness are used in a stacked structure, however, there is no description regarding a method for obtaining a solid lubricant which is composed of a same material and has different hardnesses in different regions thereof. If the hardness of the solid lubricant is changed by changing the composition thereof, the quality of application of the solid lubricant cannot be maintained at the same level over a long period of time.

Even when solid lubricant blocks, which are composed of the same material and have a different hardness, are obtained and used in a stacked structure, inflection points of consumption amount of the solid lubricant appear at boundaries between the blocks, and thus the quality of application of the solid lubricant cannot be maintained at the same level over a long period of time in this case as well.

Meanwhile, it is understood that fatty acid metal salts such as zinc stearate, as seen in Japanese Patent Application Publication (JP-B) No. 51-22380, Japanese Patent Application Laid-Open (JP-A) Nos. 2001-305907, 2007-293240, and 2007-65100, lose their lubricating properties at an early stage due to electric discharge performed in the vicinity of the image bearing member in a charging step.

Consequently, the lubricating properties of the cleaning blade and the image bearing member are impaired, and toner particles pass through therebetween (toner leakage), and thus defective images are formed.

BRIEF SUMMARY OF THE INVENTION

The present invention has been made in light of the present circumstances. An object of the present invention is to provide an image-bearing member protecting agent capable of preventing abrasion of image bearing members, toner filming, smear of charging members and toner leakage and capable of maintaining its excellent coating quality for a long time, and a method of applying the image-bearing member protecting agent.

Another object of the present invention is to provide a protective layer forming device for forming a protective layer for image bearing member.

Still another object of the present invention is to provide an image forming method and an image forming apparatus, whereby an image excellent in quality can be stably obtained over a long period of time.

Yet another object of the present invention is to provide a process cartridge capable of obtaining an image excellent in quality.

Means for achieving the above-mentioned objects are as follows:

(1) An image-bearing member protecting agent, which has a block shape and is used in an image forming process where the image-bearing member protecting agent is applied or attached to a surface of an image bearing member while being scraped off with a roll-shaped brush, the image-bearing member protecting agent including:

a fatty acid metal salt, wherein the image-bearing member protecting agent includes a plurality of small blocks and has such an orientation that one or more of the small blocks are easily separated from other small blocks, and a plurality of oriented surfaces of the plurality of small blocks are arranged in a laminated state in a substantially same direction.

(2) The image-bearing member protecting agent according to (1), wherein the image-bearing member protecting agent is formed by compression molding a particulate or granular raw material, which contains the fatty acid metal salt, in a mold, and the raw material is compressed while air contained in the raw material being pressed out in a lateral direction, so that the plurality of oriented surfaces are formed.

(3) The image-bearing member protecting agent according to one of (1) and (2), further including an inorganic lubricant.

(4) A method of applying an image-bearing member protecting agent, the method including:

applying or attaching an image-bearing member protecting agent having a block shape to a surface of an image bearing member while scraping off the image-bearing member protecting agent with a roll-shaped brush, wherein the image-bearing member protecting agent is the image-bearing member protecting agent according to any one of (1) to (3), and wherein the brush is pressed against a block surface of the image-bearing member protecting agent, the block surface being substantially parallel to oriented surfaces of the image-bearing member protecting agent.

(5) A protective layer forming device including:

a roll-shaped brush, wherein the protective layer forming device is configured to apply or attach an image-bearing member protecting agent to a surface of an image bearing member, the image-bearing member protecting agent being scraped off with the roll-shaped brush, wherein the image-bearing member protecting agent is the image-bearing member protecting agent according to any one of (1) to (3), and wherein the brush is pressed against a block surface of the image-bearing member protecting agent, the block surface being substantially parallel to oriented surfaces of the image-bearing member protecting agent.

(6) The protective layer forming device according to (5), further including a layer forming member for pressing the image-bearing member protecting agent supplied to the surface of the image bearing member to form a film.

(7) An image forming method including:

transferring a toner image formed on a surface of an image bearing member, which undergoes a process for bearing the toner image, onto a transfer medium by a transfer device, and applying or attaching, by a protective layer forming device, an image-bearing member protecting agent to the surface of the image bearing member from which the toner image has been transferred onto the transfer medium, wherein the image-bearing member protecting agent is the image-bearing member protecting agent according to any one of (1) to (3), wherein a brush is pressed against a block surface of the image-bearing member protecting agent, the block surface being substantially parallel to oriented surfaces of the image-bearing member protecting agent.

(8) An image forming apparatus including:

an image bearing member which undergoes a process for bearing a toner image, a transfer device configured to transfer the toner image formed on a surface of the image bearing member onto a transfer medium, and a protective layer forming device configured to apply or attach an image-bearing member protecting agent to the surface of the image bearing member, from which the toner image has been transferred onto the transfer medium, wherein the protective layer forming device is the protective layer forming device according to one of (5) and (6).

(9) The image forming apparatus according to (8), further including a cleaning device, wherein the cleaning device is placed downstream the transfer device and upstream the protective layer forming device along a rotational direction of the image bearing member and is configured to remove a toner remaining on the surface of the image bearing member from the surface thereof by rubbing the surface of the image bearing member.

(10) The image forming apparatus according to one of (8) and (9), wherein the image bearing member contains a thermosetting resin in at least an uppermost surface layer thereof.

(11) The image forming apparatus according to any one of (8) to (10), wherein the image bearing member is a photoconductor.

(12) The image forming apparatus according to any one of (8) to (11), further including a charging device which is provided in contact with or close to the surface of the image bearing member.

(13) The image forming apparatus according to (12), wherein the charging device includes a voltage applying device configured to apply a voltage containing an alternating current component.

(14) The image forming apparatus according to any one of (8) to (13), wherein the image bearing member is an intermediate transfer medium.

(15) The image forming apparatus according to any one of (8) to (14), wherein the toner has a circularity SR, which is represented by Equation 1, of 0.93 to 1.00.

Circularity $SR$=(periphery of a circle having the same area as a particle projection area)/(periphery of a particle projection image) Equation 1

(16) The image forming apparatus according to any one of (8) to (15), wherein a ratio (D4/D1) of a weight average particle diameter (D4) of the toner to a number average particle diameter (D1) thereof is 1.00 to 1.40.

(17) A process cartridge including:

an image bearing member which undergoes a process for bearing a toner image, and a protective layer forming device configured to apply or attach an image-bearing member protecting agent to a surface of the image bearing member from which the toner image has been transferred onto a transfer medium, the image bearing member and protective layer forming device being integrally provided, wherein the protective layer forming device is the protective layer forming device according to one of (5) and (6).

(18) The process cartridge according to (17), further including a cleaning device, wherein the cleaning device is placed upstream the protective layer forming device along a rotational direction of the image bearing member and is configured to remove a toner remaining on the surface of the image bearing member from the surface thereof by rubbing the surface of the image bearing member.

(19) The process cartridge according to one of (17) and (18), wherein the image bearing member contains a thermosetting resin in at least an uppermost surface layer thereof.

(20) The process cartridge according to any one of (17) to (19), further including a charging device which is provided in contact with or close to the surface of the image bearing member.

(21) The process cartridge according to any one of (17) to (20), further including a container for housing a toner, wherein the toner has a circularity SR, which is represented by Equation 1, of 0.93 to 1.00:

Circularity $SR$=(periphery of circle having the same area as a particle projection area)/(periphery of particle projection image) Equation 1

(22) The process cartridge according to any one of (17) to (21), wherein a ratio (D4/D1) of a weight average particle diameter (D4) of the toner to a number average particle diameter (D1) thereof is 1.00 to 1.40.

(23) An image forming apparatus including:

the process cartridge according to any one, of (17) to (22).

According to the present invention, it is possible to maintain excellent quality of application of an image-bearing member protecting agent over a long period of time and to obtain images excellent in quality over a long period of time.

DETAILED DESCRIPTION OF THE INVENTION

Hereinbelow, embodiments of the present invention will be described with reference to drawings.

An image-bearing member protecting agent according to the present embodiment essentially contains at least a fatty acid metal salt. Examples of the fatty acid metal salt include, but are not limited to, barium stearate, lead stearate, iron stearate, nickel stearate, cobalt stearate, copper stearate, strontium stearate, calcium stearate, cadmium stearate, magnesium stearate, zinc stearate, zinc oleate, magnesium oleate, iron oleate, cobalt oleate, copper oleate, lead oleate, manganese oleate, zinc palmitate, cobalt palmitate, lead palmitate, magnesium palmitate, aluminum palmitate, calcium palmitate, lead caprylate, lead caprate, zinc linolenate, cobalt linolenate, calcium linolenate, zinc ricinoleate, cadmium ricinoleate and mixtures thereof. These may be used alone or in combination.

The inorganic lubricant herein mentioned means a substance which exhibits lubricating properties by being cleaved or which induces internal lubricating action. Examples thereof include, but are not limited to, mica, boron nitride, molybdenum disulfide, tungsten disulfide, talc, kaolin, montmorillonite, calcium fluoride and graphite. Of these, boron nitride is preferable because it is a substance in which hexagonal lattice planes formed by firmly bonded atoms are laminated on top of one another with sufficient space therebetween, and the layers are bonded by only a weak van der Waals force; therefore, the layers easily cause cleavage and exhibits excellent lubricating properties.

The following describes the concept of "orientation" of an image-bearing member protecting agent in the present invention.

The term "orientation" in the present invention means a state where bonding strength of lubricant components is strong in a certain direction but is weak in the perpendicular direction thereto.

Figure 1:
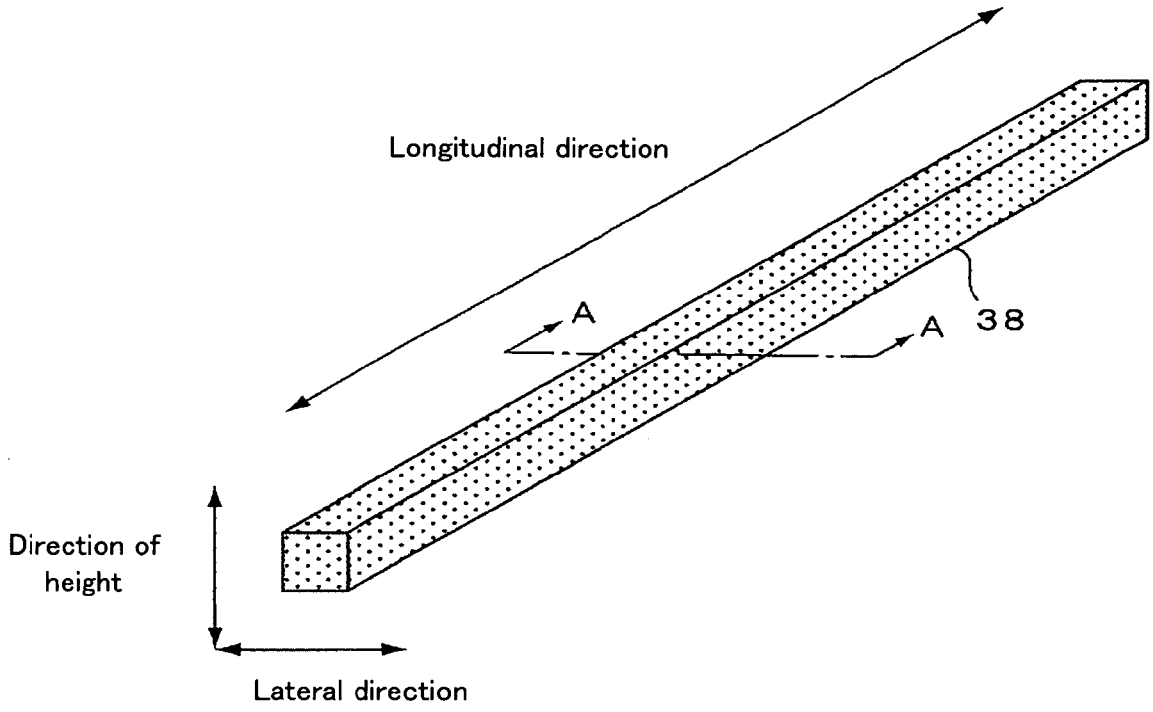
FIG. 1 is a perspective view of an image-bearing member protecting agent according to an embodiment of the present invention.

FIG. 1 is a schematic view illustrating the entirety of an image-bearing member protecting agent according to an embodiment of the present invention.

Figure 2:
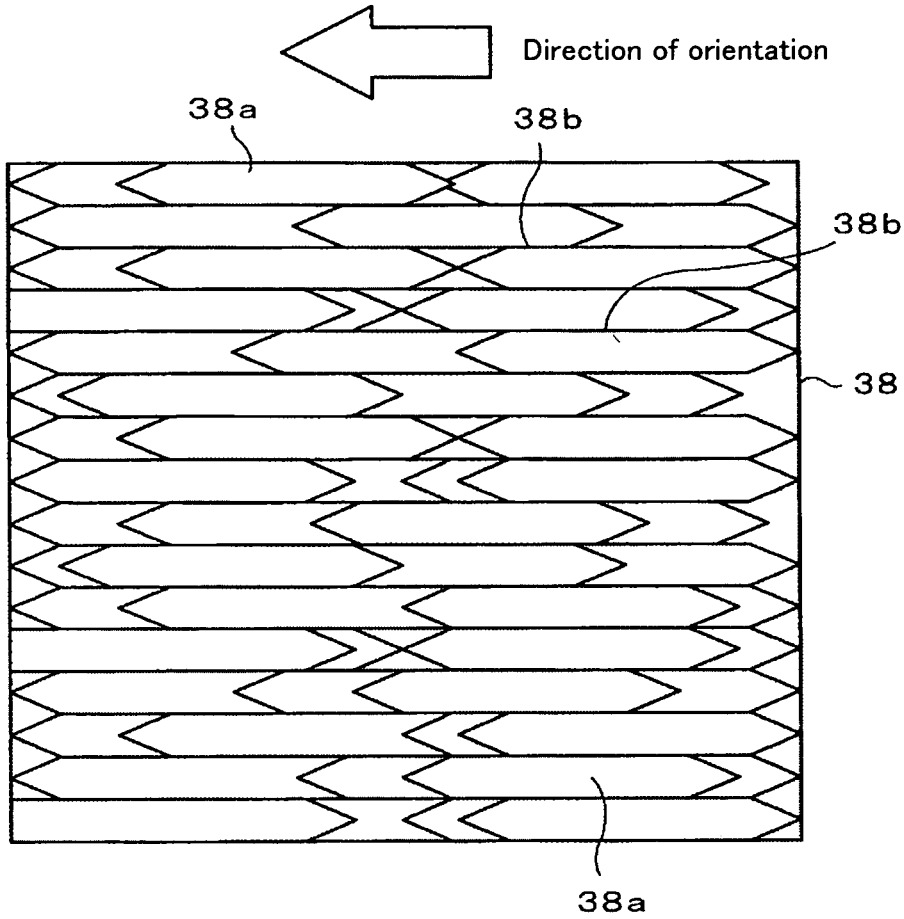
FIG. 2 is a schematically enlarged cross-sectional view taken along the A-A line in FIG. 1.

FIG. 2 is a schematically enlarged cross-sectional view taken along the A-A line in FIG. 1.

As illustrated in FIG. 2, in a block-shaped image-bearing member protecting agent 38 according to the present invention, bonded layers are arranged in a lateral direction in FIG. 1. This state is referred to as "blocks are oriented in a direction indicated by an arrow", and a surface in parallel with this direction is referred to as "an oriented surface". The description "a plurality of oriented surfaces of the plurality of small blocks are arranged in a substantially same direction" means that an angle of one oriented surface of a small block relative to the other oriented surface of another small block is within a range of ±20°.

In other words, it can be said that the image-bearing member protecting agent 38 includes a plurality of small blocks 38*a* which are laminated to one another via their oriented surfaces 38*b*. Furthermore, when individual small blocks 38*a* are viewed as layers, the oriented surfaces 38*b* thereof also serve to facilitate easy separation of the layers (have an orientation that one or more of the small blocks are easily separated from other small blocks.).

Figure 3A:
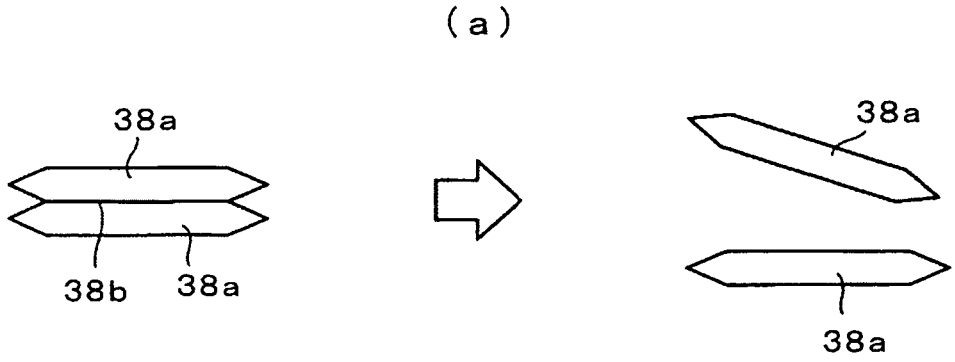
FIG. 3A is a schematic view illustrating the degree of ease in detaching a solid lubricant depending on the present or absence of oriented surfaces.
Figure 3B:
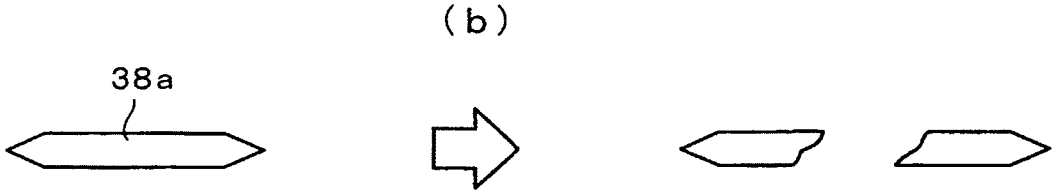
FIG. 3B is another schematic view illustrating the degree of ease in detaching a solid lubricant depending on the present or absence of oriented surfaces.

As illustrated in FIG. 3A, the small blocks 38*a* are easily separated from one another via their oriented surfaces 38*b*, however, as illustrated in FIG. 3B, individual small blocks 38*a* themselves do not separate into smaller portions unless a strong force is applied thereto.

Figure 4:
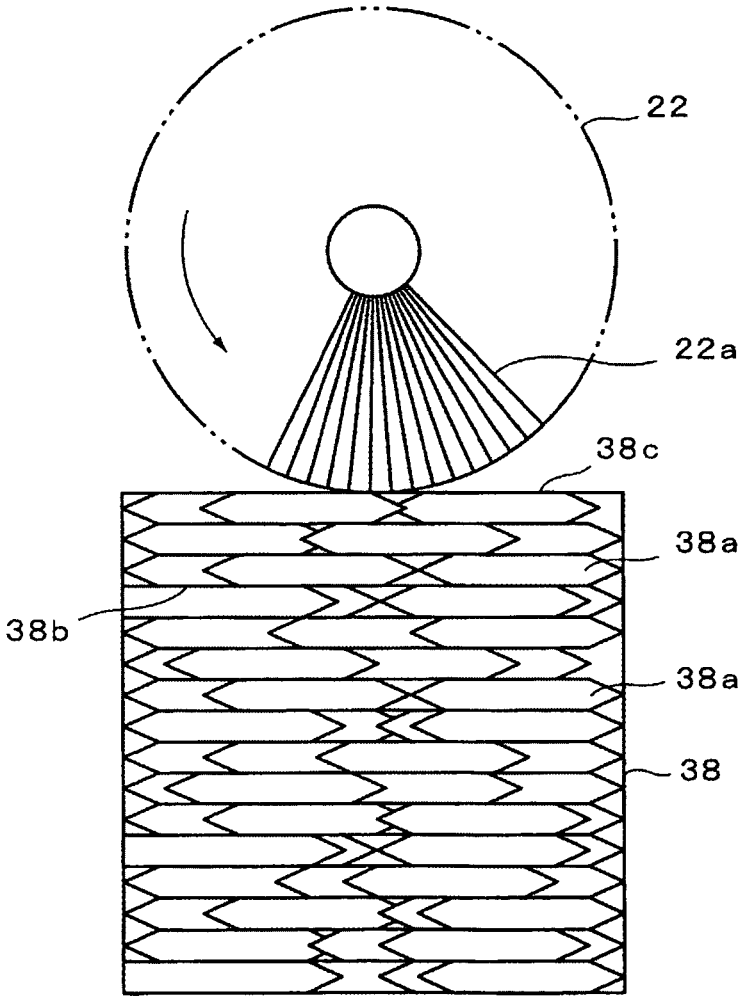
FIG. 4 is a view illustrating a state where a brush is pressed against a block surface of an image-bearing member protecting agent, substantially parallel to an oriented surface thereof.

The description "brush is pressed against a block surface of the image-bearing member protecting agent" means that as illustrated in FIG. 4, a brush roller 22 is pressed against a block surface 38*c* of image-bearing member protecting agent 38. In FIG. 4, the block surface 38*c* is substantially parallel to the oriented surfaces 38*b*, and reference numeral 22*a* denotes bristles of the brush roller 22. The description "the block surface is substantially parallel to the oriented surfaces" means that an angle of the block surface relative to the oriented surfaces is within a range of ±20°.

The presence or absence of orientation and the direction of orientation can be easily detected in the following procedure.

Figure 5:
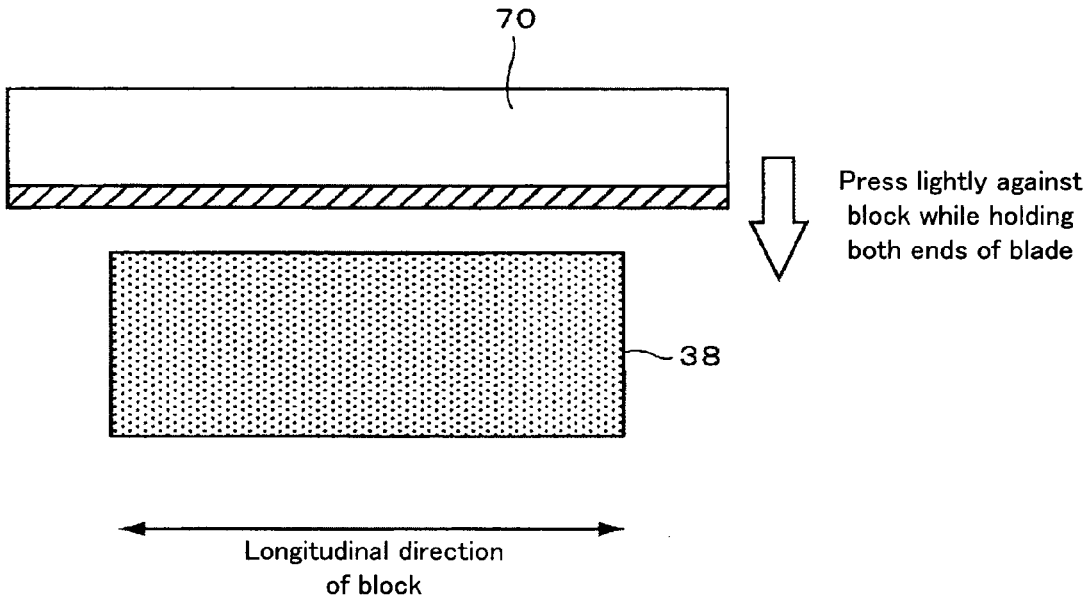
FIG. 5 is a view illustrating a method for detecting the presence or absence of orientation of an image-bearing member protecting agent.

FIG. 5 is a schematic view for illustrating a method for detecting the presence or absence of orientation of an image-bearing member protecting agent.

An image-bearing member protecting agent 38 having a predetermined length is prepared, both ends of a blade-replaceable cutter 70 are held by hand and the blade is pressed against the block.

Figure 6:
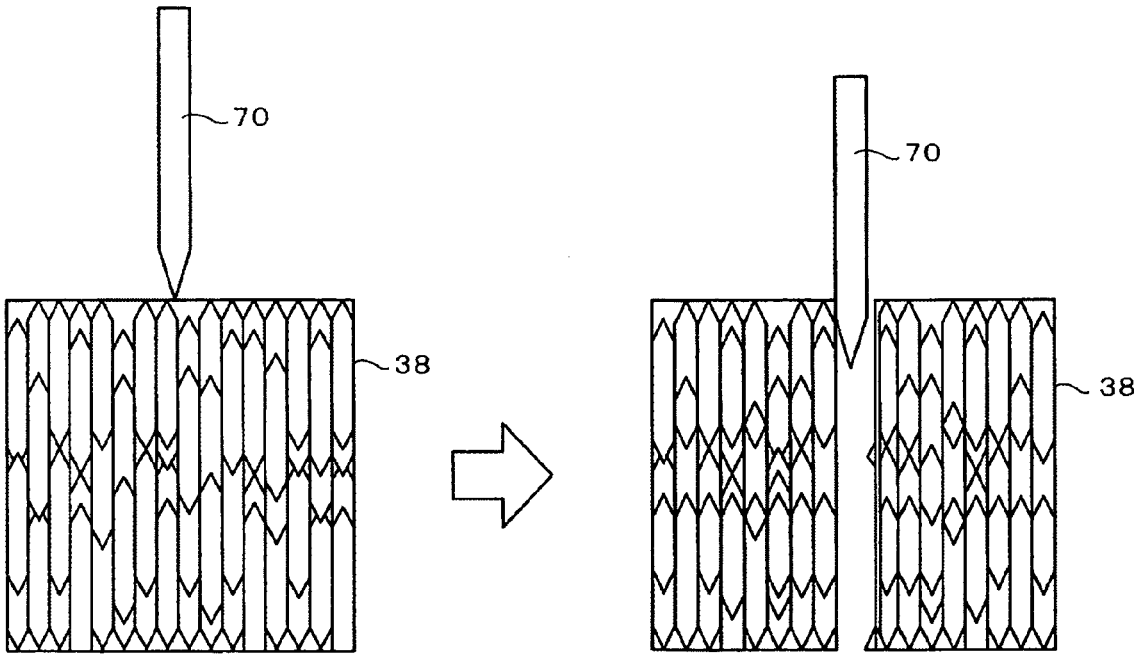
FIG. 6 is a view illustrating how an image-bearing member protecting agent is split up when a blade is pressed against the image-bearing member protecting agent in a direction parallel to the oriented surface thereof.

When the blade is pressed against the block in a direction parallel to the orientation, the image-bearing member protecting agent 38 is split along the oriented surfaces by just slightly pressing the blade against the image-bearing member protecting agent 38, as illustrated in FIG. 6.

Figure 7:
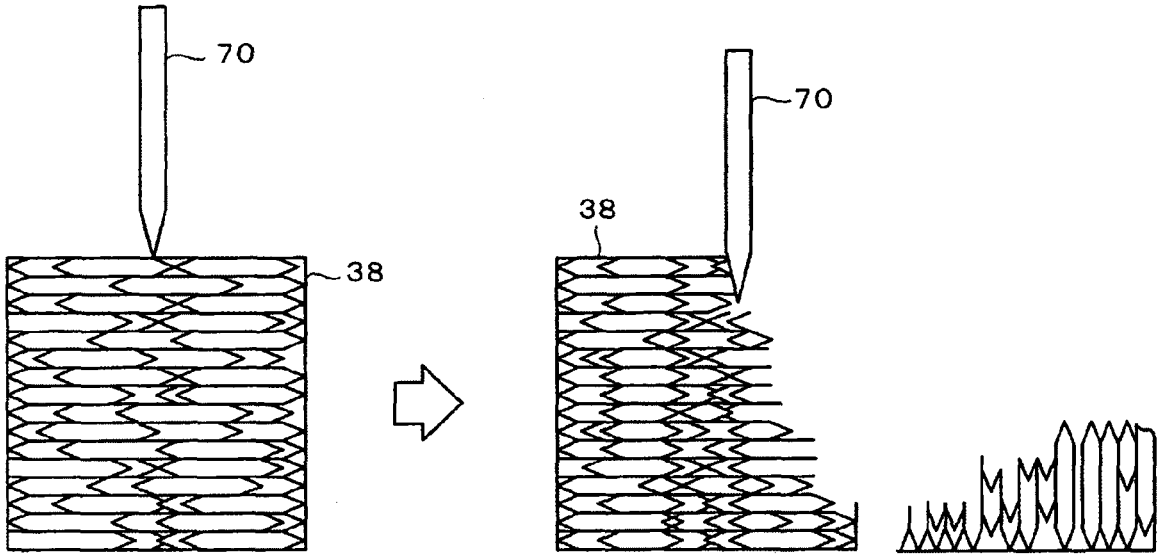
FIG. 7 is a view illustrating how an image-bearing member protecting agent is split up when a blade is pressed against the image-bearing member protecting agent in a direction perpendicular to the oriented surface thereof.

Meanwhile, in the case of a block (block of an image-bearing member protecting agent) which has oriented surfaces in a direction perpendicular to the orientation or has no orientation, slightly pressing the blade against the image-bearing member protecting agent does not split the image-bearing member protecting agent easily as illustrated in FIG. 7, the image-bearing member protecting agent 38 is destructed in a disorderly manner.

Whether the oriented surfaces are arranged in a substantially same direction can be determined by pressing the blade of a cutter into the image-bearing member protecting agent at plural positions thereof and measuring an angle formed between each of the determined oriented surfaces.

Next, the following describes an example of a method for obtaining an image-bearing member protecting agent according to the present embodiment.

In the present embodiment, a block of an image-bearing member protecting agent having orientation is obtained by the following method.

Figure 8:
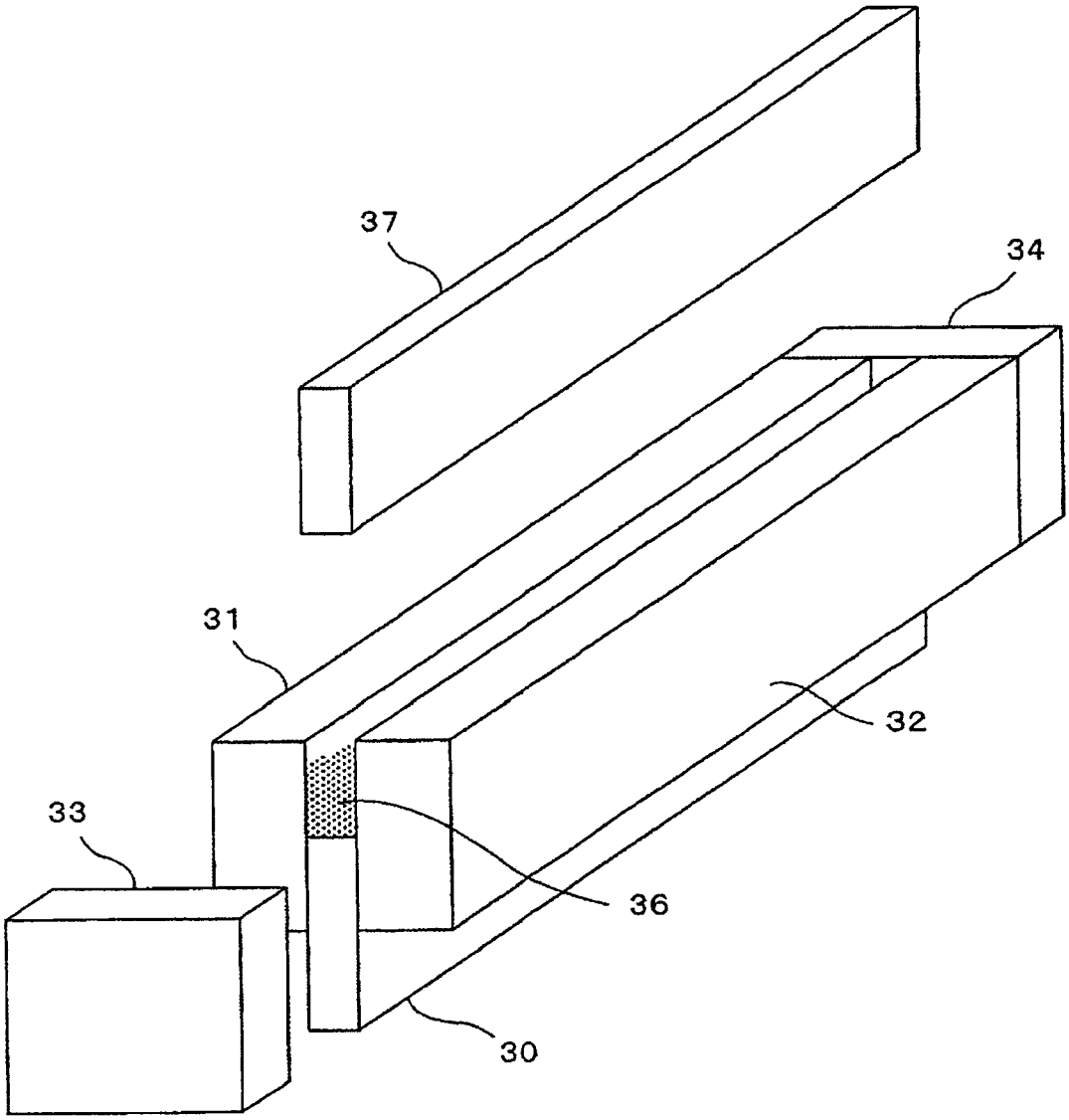
FIG. 8 is a perspective view illustrating a mold for use in compression molding an image-bearing member protecting agent of the present invention.

FIG. 8 is a schematic general view of a mold for use in producing an image-bearing member protecting agent according to the present embodiment.

An uncompressed raw material 36 is poured into a space formed by sandwiching a bottom molding plate 30 with horizontal molding plates 31, 32 and end molding plates 33, 34, and pressed with a top molding plate 37.

Figure 9A:
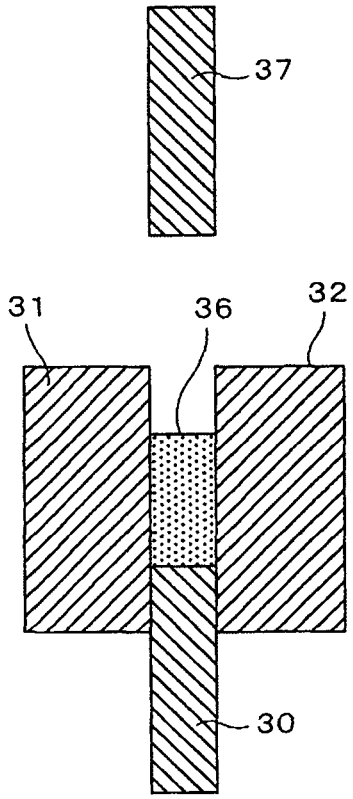
FIG. 9A is a view illustrating a compression molding step.
Figure 9B:
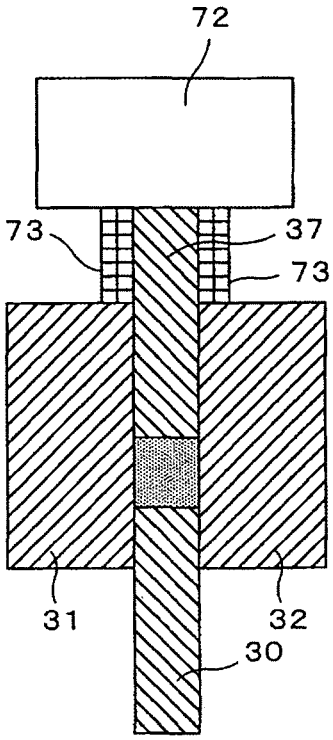
FIG. 9B is another view illustrating a compression molding step.
Figure 9C:
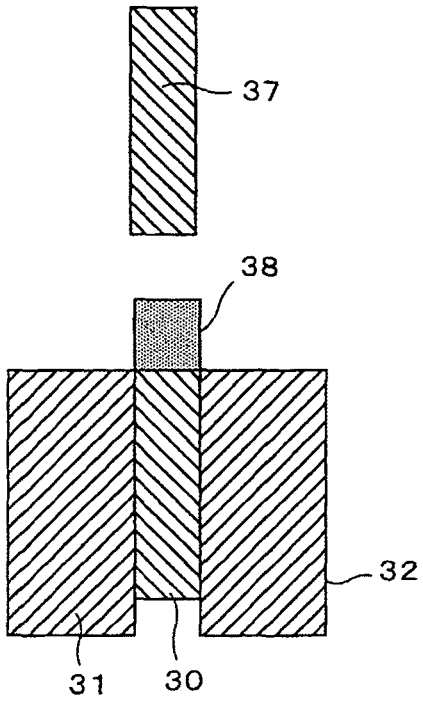
FIG. 9C is still another view illustrating a compression molding step.

FIGS. 9A to 9C are schematic cross-sectional views of the resulting image-bearing member protecting agent, as viewed from the longitudinal direction thereof. The image-bearing member protecting agent is produced after undergoing processes illustrated in FIGS. 9A to 9C.

The following describes the outline of the procedure for producing the image-bearing member protecting agent 38.

First, as illustrated in FIG. 9A, a raw material 36 is poured into a space formed by sandwiching a bottom molding plate 30 with horizontal molding plates 31, 32 and end molding plates 33, 34.

As illustrated in FIG. 9B, a top molding plate 37 is placed from above the interior space, and the raw material 36 is compressed with a press 72. At the time of compressing the raw material 36, a block having the same height can be molded by providing stoppers 73.

Figure 10:
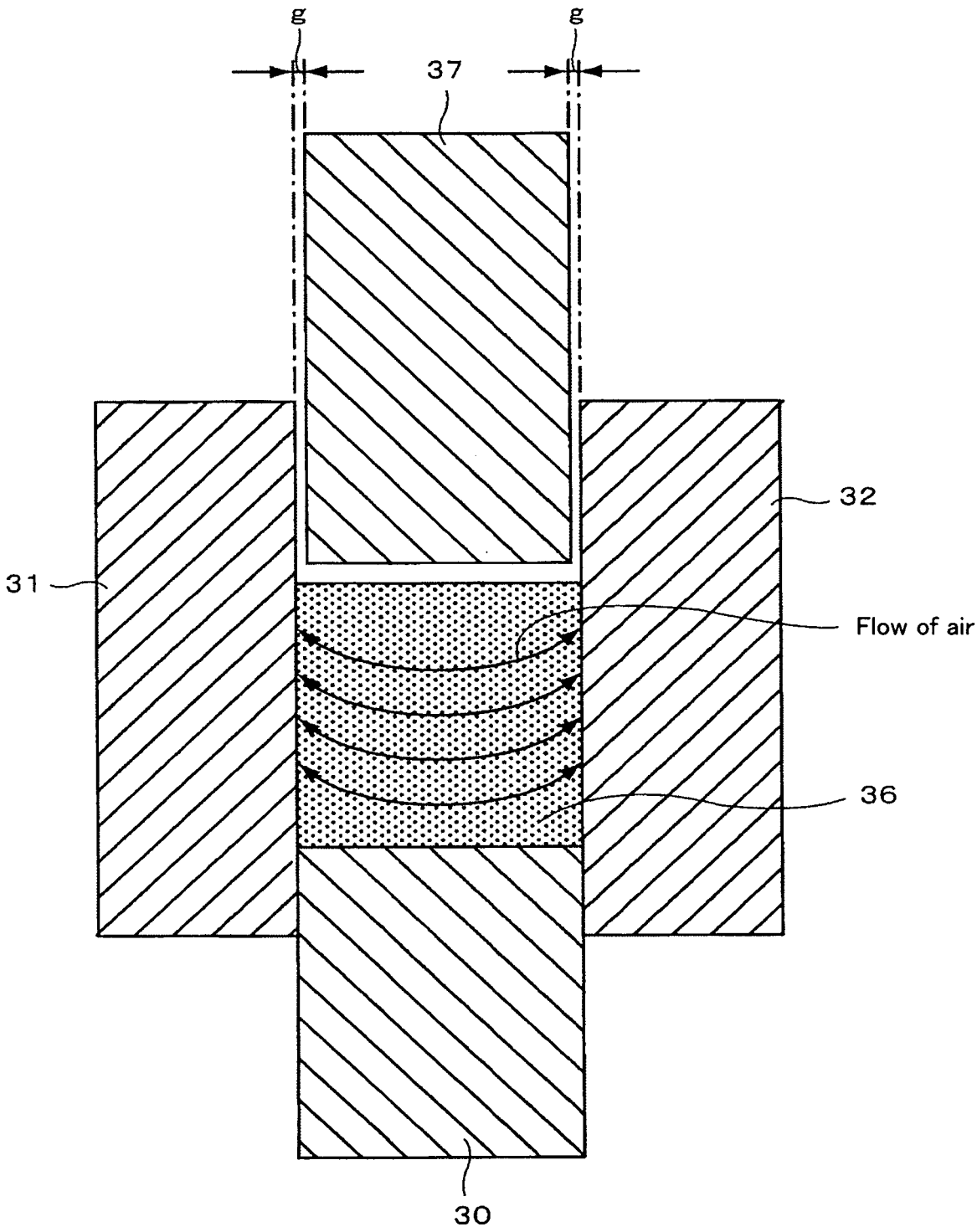
FIG. 10 is a cross-sectional view of a mold, for illustrating the principle of forming oriented surfaces of small blocks.

FIG. 10 illustrates characteristics of the compressing molding according to the present embodiment. A clearance g (0.03 mm in the present embodiment) for letting air escape from a raw material 36 is provided between the top molding plate 37 and each of the horizontal molding plates 31, 32.

When the top molding plate 37 is pressurized from above, air contained in the particulate or granular raw material 36 containing a fatty acid metal salt flows out therefrom in a lateral direction, and an orientation (an oriented surface) is formed in the raw material 36 by further pressing it from above. As illustrated in FIG. 9C, the press 72 is released to remove the top molding plate 37 and the bottom molding plate 30 is pushed up so that the image-bearing member protecting agent 38 is taken out from the space.

Note that the above production process is described by way of an example, and the procedure for producing an image-bearing member protecting agent of the present invention is not limited thereto. That is, the production process is not particularly limited as long as the raw material can be compression-molded so that oriented surfaces are formed in laminated state.

Next, a protective layer forming device, which uses an image-bearing member protecting agent produced by the above-mentioned method, and an image forming apparatus equipped with the protective layer forming device will be described below.

Figure 11:
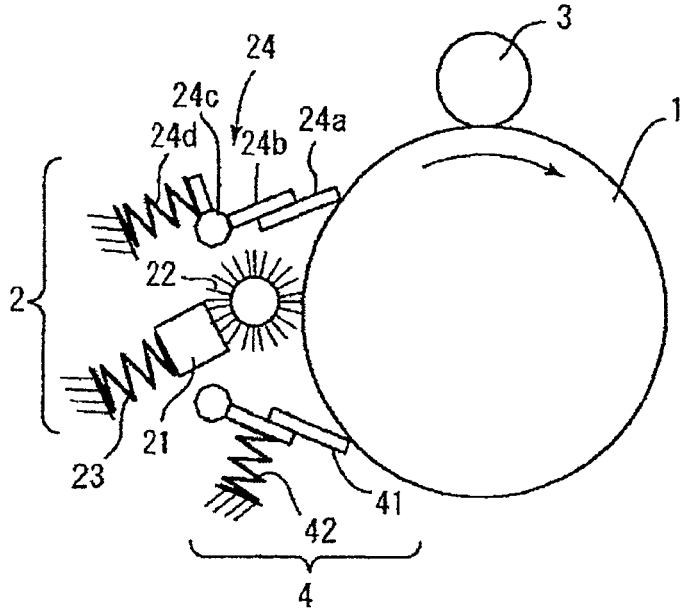
FIG. 11 is a schematic block view of a protective layer forming device according to the present embodiment.

FIG. 11 is a schematic block view of a protective layer forming device 2 according to the present embodiment. The protective layer forming device 2, which is disposed so as to face a photoconductor drum 1 provided as an image bearing member, is composed mainly of an image-bearing member protecting agent 21 (otherwise simply referred to as "protecting agent" hereinbelow) formed into a block, a brush roller 22 provided as a protecting agent supplying member, a pressing force imparting mechanism 23, a protective, layer forming mechanism 24, and the like.

The protective layer forming mechanism 24 includes a blade support member 24*b* which is provided rotatably on a shaft 24*c*; a blade 24*a*, serving as a layer forming member, which is supported by the blade support member 24*b* at one end opposite to the photoconductor drum side and comes in contact with a surface of the photoconductor drum 1 in the trailing direction; and a spring 24*d* provided as a pressing unit which biases the blade support member 24*b* in a direction indicated by the arrow (in the clockwise direction in the figure) so as to press the blade 24*a* against the surface of the photoconductor drum 1.

In FIG. 11, as a unit for biasing the pressing force imparting mechanism 23 and the protective layer forming mechanism 24, a coil spring is exemplified, however, the biasing unit is not particularly limited. The biasing unit may be, for example, a member having rubber elasticity, a flat spring or an(other) elastic members.

The image-bearing member protecting agent 21 comes in contact with the brush roller 22 by the pressing force applied by the pressing force imparting mechanism 23. The brush roller 22 rotates at a linear speed different from that of the image bearing member (photoconductor drum) 1 to rub against the surface of the image bearing member 1. At this time, the brush roller 22 supplies a small amount of the image-bearing member protecting agent held on a surface of the brush roller 22 to the surface of the image bearing member 1.

The image-bearing member protecting agent supplied to the surface of the image bearing member 1 is formed in a thin layer (a film) by the protective layer forming mechanism 24.

A deteriorated image-bearing member protecting agent is removed together with other components such as a toner remaining on an image bearing member by a typical cleaning mechanism. The cleaning mechanism may also serve as the protective layer forming device 2. However, the mechanism for removing residues on the surface of an image bearing member and the mechanism for forming a protective layer differ in scraped state of appropriate members. Therefore, in the present embodiment, these mechanisms are separated, and as illustrated in FIG. 11, a cleaning device 4 is provided downstream the after-mentioned transfer member in the rotational direction of the photoconductor drum 1 and upstream the protective layer forming device 2.

The cleaning device 4 is composed of a cleaning blade 41 as a cleaning member, a cleaning-pressing mechanism 42, and the like. In FIG. 11, a coil spring is provided as a cleaning-pressing mechanism 42 by way of an example. However, the cleaning-pressing mechanism is not particularly limited thereto, and may be, for example, a member having rubber elasticity, a flat spring or an(other) elastic members.

The material of the blade 24*a* for use in the protective layer forming mechanism 24 is not particularly limited, and elastic materials typically known as materials for cleaning blades, such as urethane rubber, hydrin rubber, silicone rubber, and fluorine rubber, can be used singularly or in the form of a blend. Also, each of these rubber blades may be subjected to coating or dipping treatment, at its portion in contact with an image bearing member, with a material having a low frictional coefficient. In order to control the hardness of the elastic material, fillers typified by organic fillers and inorganic fillers may be dispersed in the protecting agent.

The blade is secured to the blade support member 24*b* by an arbitrarily selected method such as bonding and fusing so that end portions thereof can be contacted with a surface of an image bearing member.

The thickness of the blade 24*a* cannot unequivocally defined depending on the pressing force applied thereto. However, in order to efficiently use the blade, the thickness is preferably about 0.5 mm to about 5 mm, and more preferably about 1 mm to about 3 mm.

Similarly, a so-called free length, that is, the length of the blade protruding from the support member to make the blade flexible cannot also be unequivocally defined depending on the pressing force applied thereto. However, in order to efficiently use the blade, the free length is preferably about 1 mm to about 15 mm, and more preferably about 2 mm to about 10 mm.

As for other components of the blade for forming a protective layer, a layer of resin, rubber, elastomer or the like is formed on the surface of an elastic metal blade (e.g. leaf), via a coupling agent, a primer component or the like if necessary, by a method such as coating and dipping. If necessary, the formed layer may be thermally cured, and if desired, the cured layer may be subjected to a surface polishing treatment.

In order to efficiently use the blade, the thickness of the elastic metal blade is preferably about 0.05 mm to about 3 mm, and more preferably about 0.1 mm to about 1 mm.

In order to prevent distortion of the elastic metal blade, the blade may be subjected to a bending treatment in a direction substantially parallel to the support shaft after being attached to the protective layer forming mechanism.

As materials for forming a surface layer of the elastic metal blade, fluorochemical resins (e.g. PFA, PTFE, FEP, PVdF, etc.), fluorine-based rubbers, and silicone-based elastomers (e.g. methylphenyl silicone elastomer, etc.) can be used, if necessary together with fillers, however, the materials therefor are not limited thereto.

The surface of the image bearing member is pressed by the protective layer forming mechanism 24 with a sufficient pressing force to spread the image-bearing member protecting agent 21 so as to be formed into a protective layer or protective film, at a contact linear pressure preferably of 5 gf/cm to 80 gf/cm, more preferably of 10 gf/cm to 60 gf/cm.

The brush roller 22 is favorably used as a protective agent supplying member. In this case, in order to reduce mechanical stress applied to the surface of the image bearing member, the brush fiber preferably has flexibility.

As for the flexible brush fiber, one or two or more brush fiber materials can be selected for use from among generally known materials. Specific examples of materials for the flexible brush fiber include known materials such as polyolefin-based resins (e.g. polyethylene, polypropylene); polyvinyl and polyvinylidene-based resins (e.g. polystyrene, acrylic resin, polyacrylonitrile, polyvinyl acetate, polyvinyl alcohol, polyvinyl butyral, polyvinyl chloride, polyvinyl carbazole, polyvinyl ether and polyvinyl ketone); vinyl chloride-vinyl acetate copolymers; styrene-acrylic acid copolymers; styrene-butadiene resins; fluorochemical resins (e.g. polytetrafluoroethylene, polyvinyl fluoride, polyvinylidene fluoride, polychlorotrifluoroethylene); polyester; nylon; acryl; rayon; polyurethane; polycarbonate; phenol resins; and amino resins (e.g. urea-formaldehyde resin, melamine resin, benzoguanamine resin, urea resin, polyamide resin).

Diene rubber, styrene-butadiene rubber (SBR), ethylene propylene rubber, isoprene rubber, nitryl rubber, urethane rubber, silicone rubber, hydrin rubber, norbornene rubber etc. may be combined to control the flexibility.

Support members for the protective agent supplying member 22 are classified into fixed type support members and rotatable roll-shaped support members. The rolled-shaped support member includes a roll brush formed of a metallic shaft on which a brush fiber pile tape is spirally wound. The brush fiber preferably has a diameter of from about 10 μm to about 500 μm and has a length of from 1 mm to 15 mm. The brush fiber density is preferably from 10,000 to 300,000/square inch, i.e., from $1.5\times10^7/m^2$ to $4.5\times10^8/m^2$.

The brush fiber density is preferably as high as possible in terms of uniform and stable application of the protective agent. One fiber is preferably formed of from a few fine fibers to a few hundred fine fibers. For example, just as 333 decitex=6.7 decitex×50 filaments (300 denier=6 denier×50 filaments), 50 fine fibers of 6.7 decitex (6 denier) can be implanted as one fiber.

The brush may have a coated layer to stabilize the surface shape and environmental resistance. The coated layer preferably includes a deformable component in compliance with flexibility of the brush fiber. Specific examples thereof are not limited if they are capable of maintaining flexibility, and include polyolefin resins such as polyethylene, polypropylene, polyethylene chloride; chlorosulfonated polyethylene; polyvinyl and polyvinylidene resins such as polystyrene, acrylic resins (e.g. polymethylmethacrylate), polyacrylonitrile, polyvinyl acetate, polyvinyl alcohol, polyvinylbutyral, polyvinylchloride, polyvinyl carbazole, polyvinyl ether and polyvinylketone; vinyl chloride-vinylacetate copolymers; silicone resins formed of organosiloxane bonding or their modified resins (e.g. modified alkyd resins, polyester resins, epoxy resins and polyurethane); fluorine-containing resins such as perfluoroalkyl ether, polyfluorovinyl, polyfluorovinylidene and polychlorotrifluoroethylene; polyamide; polyester; polyurethane; polycarbonate; amino resins such as urea-formaldehyde resins; epoxy resins; and their composite resins.

Figure 12:
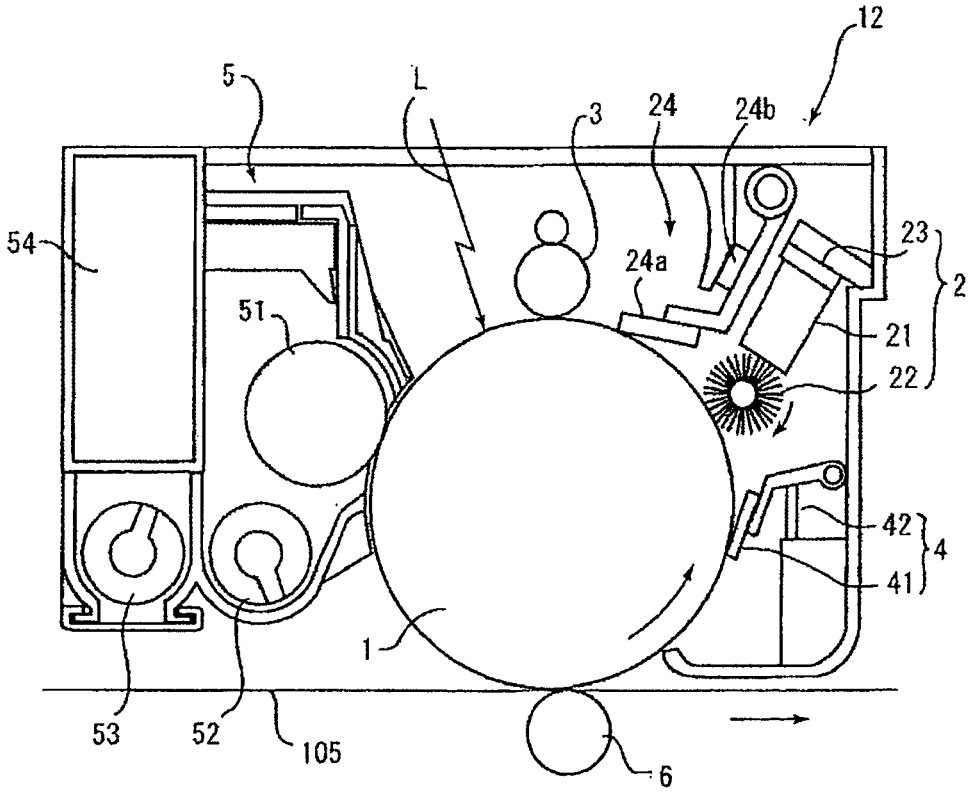
FIG. 12 is a schematic block view of an image forming apparatus provided with a protective layer forming device according to the present embodiment.

FIG. 12 is a schematic cross-sectional view illustrating a configuration example of a process cartridge provided with a protective layer forming device 2.

In a process cartridge 12, a photoconductor drum 1, a protective layer forming device 2, a charging roller 3, a developing roller 5, a cleaning device 4, etc. are integrally housed. The developing roller 5 includes a developing roller 51, conveying screws 52, 53 for circulating a developer while stirring and conveying the developer, a pre-set case 54 for housing a toner, and the like.

On the surface of the photoconductor drum 1, an image-bearing member protecting agent partially deteriorated and toner components remain after a transfer process. The residues left on the surface of the photoconductor drum 1 are removed by a cleaning blade 41 so as to be cleaned.

The cleaning blade 41 is contacted to the photoconductor drum 1 at an angle like a (leading) counter type.

To the surface of the photoconductor drum 1 from which residues of toner and deteriorated image-bearing member protecting agent have been removed by the cleaning device 4, an image-bearing member protecting agent 21 is supplied from a protective agent supplying member 22, and a film-like protective layer is formed by the protective layer forming mechanism 24.

The photoconductor drum 1 having, on its surface, the protective layer formed by the protective layer forming device 2 is then charged and exposed to an exposure light L such as a laser so that a latent electrostatic image is formed on the surface. This latent image is visualized as a toner image (a visible image) by the developing roller 5. The toner image is transferred to an intermediate transfer belt 105 as a transfer medium by a transfer roller 6 as an image transfer device which is placed outside the process cartridge 12. In the case of a direct transfer mode, a sheet-type recording medium is used as the transfer medium.

Figure 13:
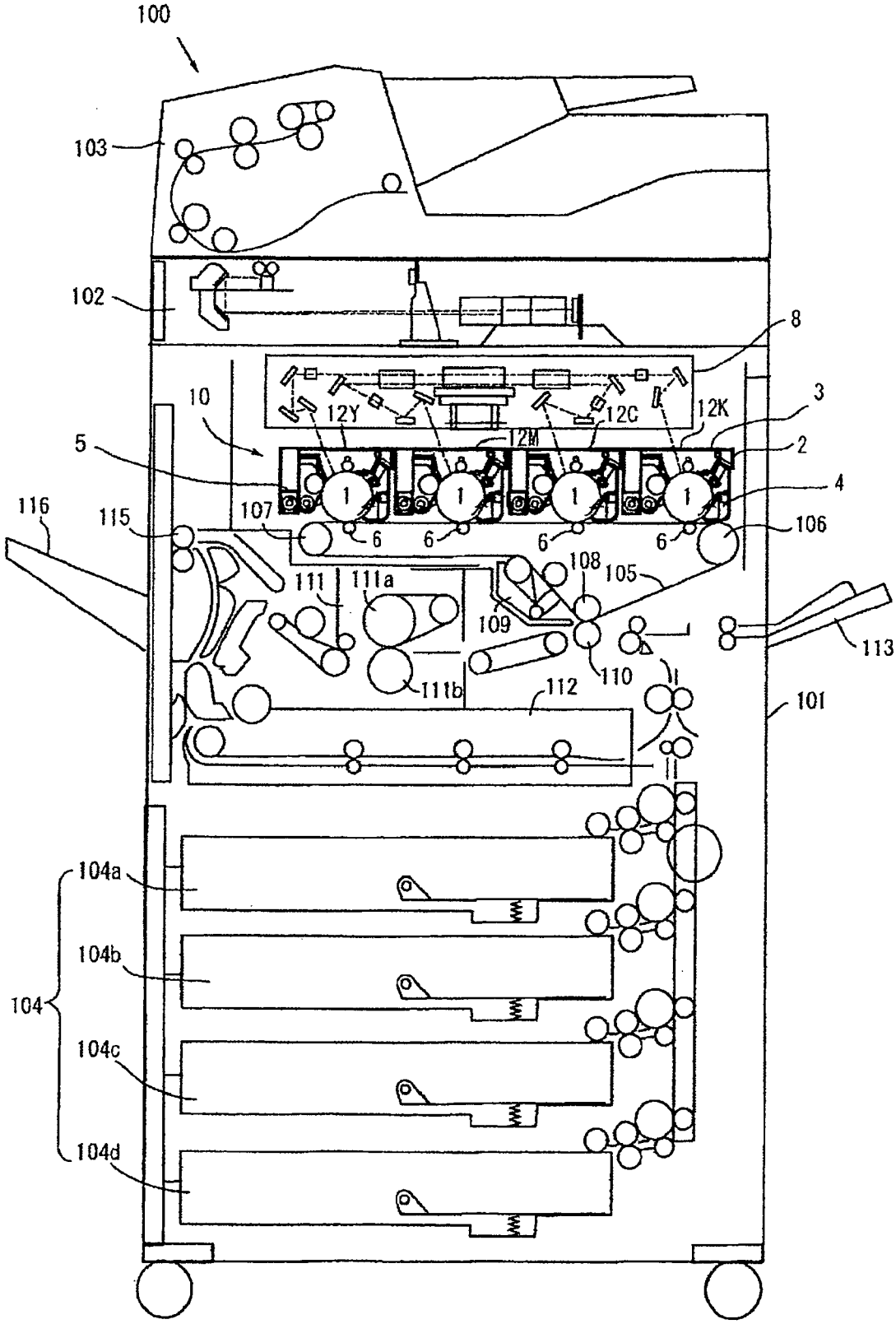
FIG. 13 is a schematic block view of an image forming apparatus according to the present embodiment.

FIG. 13 is a cross-sectional view illustrating an example of a tandem type color copier 100 as in image forming apparatus, employing an intermediate transfer mode and including a process cartridge 12. In the present embodiment, the image forming apparatus is structured to have a protective layer forming device 2 by attaching the process cartridge 12 thereto, however, the protective layer forming device 2 may be directly incorporated thereinto.

A color copier 100 includes a main body 101, a scanner 102 located on the main body 101, an automatic document feeder (ADF) 103 located on the scanner 102.

At the lower part of the main body 101 of the image forming apparatus 100, a paper feeder 104, equipped with a plurality of paper feeder cassettes 104*a*, 104*b*, 104*c*, and 104*d*, is provided.

At a substantially center part of the apparatus main body 101, an intermediate transfer belt 105 serving as an intermediate image transferer is arranged. The intermediate transfer belt 105 is an endless belt and is designed such that the endless belt is spanned over support rollers 106, 107, and 108 etc. and driven by a not-illustrated driving source to rotate in the clockwise direction in the figure.

Near the support roller 108, an intermediate-transfer-member-cleaning device 109 is placed, which removes a residual toner remaining on the 108 after secondary transfer of an image.

Above the intermediate transfer belt 105, which is spanned over the support roller 106 and support roller 107, process cartridges 12Y, 12M, 12C, and 12K serving as four image forming units of yellow (Y), magenta (M), cyan (C) and black (K) are arrayed in parallel in a moving direction of the intermediate transfer belt 105 to thereby constitute a tandem image-forming section 10. Note that the order of arrangement of these four color units is not limited thereto.

An exposer 8 is arranged above the tandem image forming section 10. A secondary image transfer roller 110 serving an image transferer is arranged to face the support roller 108 with the interposition of the intermediate transfer belt 105. An image on the intermediate transfer belt 105 is transferred onto a sheet (paper) fed from the paper feeder 104 by the secondary transfer roller 110.

A fixing device 111, which is configured to fix a transferred image on a sheet, is arranged on the left side of the secondary transfer roller 110 in the figure. The fixing device 111 includes a fixing belt 111*a* which is an endless belt, and a pressure roller 111*b* which is arranged so as to be pressed by the fixing belt 111*a*.

The tandem type image forming apparatus is further provided with a sheet reverser 112 below the fixing device 111. The sheet reverser 112 is capable of reversing the recording sheet so as to form images on both sides of the recording sheet.

Hereinafter, an image forming process using negative/positive process will be described. The photoconductor drum 1 may be an OPC (organic photoconductor) having an organic photoconductive layer, which is de-charged by a decharging lamp (not illustrated) to prepare for an image forming operation. The photoconductor drum 1 is uniformly charged to a negative charge by the charging roller 3 (FIG. 11).

The charging roller 3 is applied with a given voltage, such as direct current voltage superimposed with alternating-voltage, from a voltage power source (not illustrated), in which such given voltage is used to charge the photoconductor drum 1 to a given potential.

The charged photoconductor drum 1 is then irradiated with a laser beam emitted from the exposer 8 to form a latent image on the charged photoconductor drum 1, in which an absolute potential value of light-exposed portion becomes smaller than an absolute potential value of non-exposed portion.

The laser beam, emitted by a laser diode, is reflected by a polygon mirror rotating at a high speed, and then scanned on the surface of the photoconductor drum 1 in an axial direction of the photoconductor drum 1.

Such formed latent image is then developed by a developer supplied from a developing roller 51 of the developing device 5, as a visible toner image. The developer may be toner-only component or a mixture of toner particles and carrier particles.

When developing the latent image, a voltage power source (not illustrated) may supply a given developing bias voltage to the developing sleeve, wherein such developing bias voltage may be direct-current voltage or a voltage having direct-current voltage superimposed with alternating-current voltage having a voltage value, set between a potential of light-exposed portion and a potential of non-exposed portion of the photoconductor drum 1, for example.

The toner images formed on the photoconductor drum 1 are transferred to the intermediate transfer belt 105 by the transfer roller 6, and such toner image is then transferred from the intermediate transfer belt 105 to a transfer medium such as a paper fed from the sheet feeder 104 or a manual tray 113 by the secondary transfer roller 110, by which a superimposed color (toner) image is formed on the sheet.

In such transfer process, the transfer roller 6 is preferably supplied with a transfer bias voltage having a polarity opposite to a polarity of toner particles.

Then, toner particles remaining on the photoconductor drum 1 are removed by the cleaning blade 41, and then recycled to a toner recycling section in the cleaner 4.

Then, the sheet is transported to the fixing device 111 to fix the toner image on the sheet by applying heat and pressure. After the fixing process, the sheet is ejected to a tray 116 by a pair of ejection rollers 115.

Further, the image forming apparatus 100 can print images on both surfaces of a transfer medium. When printing images on both surfaces, a transport route after the fixing device 111 is switched to transport the sheet to the sheet reverser 112 to reverse the sheet, and then the sheet is fed to a secondary transfer nip again to form an image on its back surface of the sheet. Then, the sheet is transported to the fixing device 111 to fix toner images on the sheet, and the sheet is ejected to the tray 116 by the ejection rollers 115.

After an image transfer process, the intermediate-transfer-belt cleaning device 109 removes toner remaining on the intermediate transfer belt 105 to prepare for another image forming operation by the tandem image-forming section 10.

The image forming apparatus may employ a "tandem type intermediate transfer method" in which a plurality of developing devices, as mentioned above, are used, and a plurality of different-color toner images produced by the plurality of developing devices are sequentially transferred to an intermediate transfer member once and then further transferred to a transfer medium (e.g. paper) at a time, and then the toner images are fixed. Alternatively, the image forming apparatus may employ a "tandem type direct transfer method", in which a plurality of toner images, which are formed similarly to the same manner, can be directly transferred from photoconductor drums, in a superimposed manner, to a transfer medium, and then the toner images are fixed.

In the image forming apparatus, the charging roller preferably contacts the photoconductor drum or is preferably disposed opposite to the photoconductor drum across a tiny gap. With this configuration, the charging roller can reduce oxidizing gas generation, such as ozone, compared to a corona discharge unit, such as corotron, scorotron charging using wire for discharge during a charging process. However, because electrical discharge occurs proximity to the photoconductor surface when such charging roller is used, the photoconductor drum receives a greater electrical stress. With use of the protective layer forming device using the image-bearing member protecting agent of the present invention, the photoconductor can be stably maintained without substantially causing deterioration of the image bearing member over a long period of time. Thus, variations of images with time and environmental variations of images can be greatly reduced, and image quality can be stably maintained.

The image-bearing member protecting agent of the present invention is attached to a surface of an image bearing member and cured to generate its protection effect, and thus is relatively plastically deformable.

When a block-shaped image-bearing member protecting agent component is directly pressed against a surface of an image bearing member to form a protective layer, the protective agent is supplied in excess, which is not only poor in efficiency in forming a protective layer, but also may cause a problem, for example, the transmission of light in an exposure process is inhibited during formation of a latent electrostatic image because plural protective layers are formed. Thus, species of usable image-bearing member protecting agent are limited.

In contact, when a protective layer forming device is designed to have the above-mentioned configuration, and a supply member (brush roller 22) is arranged between an image-bearing member protecting agent and the image bearing member, the image-bearing member protecting agent can be uniformly supplied to a surface of the image bearing member, even with use of a soft type protective agent.

When a layer forming member for pressing an image-bearing member protecting agent against the protective layer forming device 2 is provided, the layer forming member may also serve as a cleaning member. However, to form a protective layer in an secured manner, it is preferred to preliminarily remove residues mainly containing toner components on the image bearing member by a cleaning member so as not to be mixed inside the protective layer.

With this configuration, the image bearing member can be continuously used for an extremely long term without being replaced.

In particular, when an image bearing member containing at its surface as an outermost surface layer a thermosetting resin a thermosetting resin, the deterioration of the image bearing member due to electric stress is prevented using the image-bearing member protecting agent, thereby the image bearing member containing the thermosetting resin can continuously have durability to mechanical stress for a long period of time.

With this, the durability of the image bearing member can be increased to a level where it can be actually used without replacement.

In addition, a charging device arranged in contact with or close to a surface of an image bearing member tends to greatly undergo electric stress because a discharge area is near the image bearing member. However, the image forming apparatus of the present invention, in which an image-bearing member protective agent is formed, can be used without exposed to such electric stress.

Since changes in surface condition of the image bearing member can be greatly reduced by the effect of the protective layer, cleaning of the image bearing member can be stably performed for a long period of time, even with use of a toner having a high circularity and a relatively large average particle diameter, which tends to sensitively vary in condition of an image bearing member depending on cleaning performance of the surface thereof.

A process cartridge is configured to include a protective layer forming device 2 containing the image-bearing member protecting agent can set a replacement time interval thereof extremely long, and thereby making it possible to reduce running cost and to drastically reduce the amount of waste.

In particular, when a thermosetting resin is contained in at least an outermost surface layer of an image bearing member, the deterioration of the image bearing member due to electric stress can be prevented using the image-bearing member protecting agent, thereby the image bearing member containing the thermosetting resin can continuously have durability to mechanical stress for a long period of time.

In addition, as described above, the components for use in the image-bearing member protecting agent do not actually contain metal components, do not contaminate a charging member disposed in contact with or close to the image bearing member used, and thus it is possible of reduce temporal change of the charging device.

For these reasons, component parts of the process cartridge such as an image bearing member and a charging member can be easily reused, thereby making it possible to further reduce the amount of waste.

Next, a photoconductor preferably used in the present invention will be described.

The photoconductor for use in the present invention includes a conductive support and a photosensitive layer formed on the conductive support. The photosensitive layer encompasses a single layer in which a charge generation material and a charge transporting material are mixed; ordinarily-layered type photosensitive layer including a charge generation layer and a charge transporting layer formed thereon; and a reverse layer type photosensitive layer including a charge transport layer and a charge generation layer formed thereon. The photoconductor can have a protective layer on the photosensitive layer to improve the mechanical strength, abrasion resistance, gas resistance and cleanability thereof. The photoconductor may have an undercoat layer between the photosensitive layer and the conductive support. Each of the layers can include a plasticizer, an antioxidant, a leveling agent, etc. in an appropriate amount when necessary.

Suitable materials for use as the conductive support include materials having a volume resistance of $10^{10}$ Ω·cm or less. For example, the support may be prepared by applying a metal such as aluminum, nickel, chromium, nichrome, copper, gold, silver, or platinum or the like, or a metal oxide such as tin oxide or indium oxide or the like, for example, by vapor deposition or sputtering, onto film-form or cylindrical plastic or paper, or using a sheet of aluminum, aluminum alloy, nickel, or stainless steel or the like, and making it into a crude tube by extrusion or drawing or the like, and then surface-treating the tube by cutting, super-finishing, or grinding or the like. The drum-shaped support preferably has a diameter of from 20 mm to 150 mm, more preferably from 24 mm to 100 mm, and still more preferably from 28 mm to 70 mm. When the diameter is smaller than 20 mm, a charger, an exposer, a developing device, a transferer and a cleaning device are physically difficult to locate around the drum. When the diameter is greater than 150 mm, the image forming apparatus needs to be larger. Particularly, in the case of a tandem type image forming apparatus, there is a need to load a plurality of photoconductors, and thus the drum preferably has a diameter of 70 mm or smaller, and more preferably 60 mm or smaller. Further, the endless nickel belt and endless stainless belt disclosed in JP-B No. 52-36016 may also be used as the conductive support.

The undercoat layer of the photoconductor for use in the image forming apparatus of the present invention includes, for example, a resin, a mixture of a white pigment and a resin or an oxidized metallic film which is a chemically or electrically oxidized surface of the conductive support, among which the mixture of a white pigment and a resin is preferably used. Specific examples of the white pigment include metal oxides such as a titanium oxide, an aluminum oxide, a zirconium oxide and a zinc oxide, among which the titanium oxide preventing a charge from being injected into the undercoat layer from the conductive is most preferably included therein.

Specific examples of the resin for use therein include thermoplastic resins such as polyamide, polyvinyl alcohol, casein and methylcellulose; and thermosetting resins such as an acrylic resin, a phenol resin, a melamine resin, an alkyd resin, an unsaturated polyester resin, an epoxy resin, and a mixture of two or more of these resins.

Specific examples of the charge generating material of the photoconductor for use in the image forming apparatus of the present invention include azo pigments such as monoazo pigments, bisazo pigments, trisazo pigments and tetrakis azo pigments; organic pigments and dyes such as triarylmethane dyes, thiazine dyes, oxazine dyes, xanthene dyes, cyanine dyes, styryl dyes, pyrylium dyes, quinacridone dyes, indigo dyes, perylene dyes, polycyclic quinone pigments, bisbenzimidazole pigments, indanthrone pigments, Squarylium pigments and phthalocyanine pigments; and inorganic materials such as serene, serene-arsenic, serene-tellurium, cadmium sulfide, zinc oxide, titanium oxide and amorphous silicone. These charge generating materials can be used alone or in combination. The undercoat layer may be a single layer or composed of a plurality of layers.

Specific examples of the charge transporting material of the photoconductor for use in the image forming apparatus of the present invention include anthracene derivatives, pyrene derivatives, carbazole derivatives, tetrazole derivatives, metallocene derivatives, phenothiazine derivatives, pyrazoline derivatives, hydrazone compounds, styryl compounds, styryl hydrazone compounds, enamine compounds, butadiene compounds, distyryl compounds, oxazole compounds, oxadiazole compounds, thiazole compounds, imidazole compounds, triphenylamine derivatives, phenylenediamine derivatives, aminostilbene derivatives, and triphenylmethane derivatives. These may be used alone or in combination.

Binder resins for use in forming the photosensitive layer including the charge generating layer and the charge transporting layer are insulative and known materials such as thermoplastic resins, thermosetting resins, photocurable resins, and photoconductive resins. Suitable examples thereof include, but are not limited to, thermoplastic resins such as polyvinyl chloride, polyvinylidene chloride, vinyl chloride-vinyl acetate copolymers, vinyl chloride-vinyl acetate-maleic anhydride copolymers, ethylene-vinyl acetate copolymers, polyvinyl butyral, polyvinyl acetal, polyester, phenoxy resins, (metha)acrylic resins, polystyrene, polycarbonate, polyarylate, polysulfone, polyether sulfone and ABS resins; thermosetting resins such as phenol resins, epoxy resins, urethane resins, melamine resins, isocyanate resins, alkyd resins, silicone resins and thermosetting acrylic resins; and photoconductive resins such as polyvinyl carbazole, polyvinyl anthracene and polyvinyl pyrene. These may be used alone or in combination.

As for the antioxidant, for example, the following can be used.

(Monophenolic Compound)

Specific examples of monophenolic compounds include 2,6-di-t-butyl-p-cresol, butylated hydroxyanisole, 2,6-di-t-butyl-4-ethylphenol, stearyl-β-(3,5-di-t-butyl-4-hydroxyphenyl) propionate, and 3-t-butyl-4-hydroxyanisole.

(Bisphenolic Compound)

Specific examples of bisphenolic compounds include 2,2'-methylene-bis-(4-methyl-6-t-butylphenol), 2,2'-methylene-bis-(4-ethyl-6-t-butylphenol), 4,4'-thiobis-(3-methyl-6-t-butylphenol) and 4,4'-butylidenebis-(3-methyl-6-t-butylphenol).

(Phenolic Polymer Compound)

Specific examples of phenolic polymer compounds include 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, and tocophenol compounds.

(Paraphenylenediamine Compound)

Specific examples of paraphenylenediamine compounds include N-phenyl-N' isopropyl-p-phenylenediamine, N,N'-di-sec-butyl-p-phenylenediamine, N-phenyl-N-sec-butyl-p-phenylenediamine, N,N'-di-isopropyl-p-phenylenediamine, and N,N'-dimethyl-N,N'-di-t-butyl-p-phenylenediamine.

(Hydroquinone compound)

Specific examples of hydroquinone compounds include 2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

(Organic Sulfur-Containing Compound)

Specific examples of organic sulfur-containing compounds include dilauryl-3,3'-thiodipropionate, distearyl-3,3'-thiodipropionate, and ditetradecyl-3,3'-thiodipropionate.

(Organic phosphorous-containing compound)

Specific examples of organic phosphorus-containing compounds include triphenylphosphine, tri(nonylphenyl)phosphine, tri(dinonylphenyl)phosphine, tricresylphosphine, and tri(2,4-dibutylphenoxy)phosphine.

Specific examples of the plasticizer usable in the present invention include plasticizers for typical resins, such as dibutylphthalate and dioctylphthalate, and each layer preferably includes the plasticizer in an amount of from 0 parts by weight to 30 parts by weight per 100 parts by weight of the binder resin.

A leveling agent may be added in the charge transporting layer. Specific examples of the leveling agent include silicone oil such as dimethyl silicone oil and methylphenyl silicone oil; and polymers or oligomers having a perfluoroalkyl group in the side chain, and each layer preferably includes the leveling agent in an amount of from 0 parts by weight to 1 part by weight per 100 parts by weight of the binder resin.

As described above, the surface layer is provided for improving the mechanical strength, abrasion resistance, gas resistance, cleanability etc. of the photoconductor. Examples of materials for use in the surface layer include a polymer and a polymer in which an inorganic filler is dispersed, which have mechanical strength higher than the photosensitive layer. The polymer for use in the surface layer may be a thermoplastic polymer or a thermosetting polymer. However, the thermosetting polymer is more preferably used because of having high mechanical strength and high capability to prevent abrasion caused by friction with a cleaning blade. The surface layer does not necessarily have charge transportability as long as it is formed thin. If a surface layer having no charge transportability is formed thick, it tends to cause a decrease in photosensitivity of the photoconductor, an increase in potential after exposure process and an increase in residual potential of the photoconductor. Thus, it is preferred to incorporate the above-mentioned charge transporting material in the surface layer or to use a polymer for use in the protective layer, and a polymer having charge transportability.

The photosensitive layer and the surface layer are greatly different in mechanical strength, and thus the protective layer is abraded away by friction with the cleaning blade, and then the photosensitive layer is abraded. Therefore, when a surface layer is provided, it is important to form the layer so as to have a sufficient thickness, and the thickness is 0.01 μm to 12 μm, preferably 1 μm to 10 μm, and more preferably 2 μm to 8 μm. When the thickness of the surface layer is 0.1 μm or less, the surface layer tends to partially lose its thickness due to friction with the cleaning blade because of its thin thickness, and unfavorably, abrasion of the photosensitive layer proceeds from the lost part. When the thickness of the surface layer is 12 μm or more, a decrease in photosensitivity of the photoconductor, an increase in potential after exposure process and an increase in residual potential of the photoconductor are likely to occur. Therefore, particularly when a polymer having charge transportability is used, it is unfavorable in terms of high cost of the polymer.

Polymers for use in the surface layer are desirably transparent to writing light used during image formation and superior in insulating properties, mechanical strength and adhesiveness. Specific examples thereof include ABS resins, ACS resins, olefin-vinyl monomer copolymers, chlorinated polyethers, aryl resins, phenolic resins, polyacetal resins, polyamide resins, polyamideimide resins, polyacrylate resins, polyarylsulfone resins, polybutylene resins, polybutylene terephthalate resins, polycarbonate resins, polyether sulfone resins, polyethylene resins, polyethylene terephthalate resins, polyimide resins, acrylic resins, polymethyl pentene resins, polypropylene resins, polyphenylene oxide resins, polysulfone resins, polystyrene resins, AS resins, butadiene-styrene copolymers, polyurethane resins, polyvinyl chloride resins, polyvinylidene chloride resins, and epoxy resins. These polymers may be thermoplastic polymers. In order to improve the mechanical strength of polymer, the polymer may be crosslinked with a crosslinker having a polyfunctional acryloyl group, carboxyl group, hydroxyl group or amino group to be a thermosetting polymer. With this, the mechanical strength of the surface layer can be increased, and the amount of abrasion of the photoconductor surface due to friction with a cleaning blade can be significantly reduced.

As described above, the surface layer preferably has charge transportability. To impart charge transportability to the surface layer, the following methods are considered: a method of mixing a polymer for use in the surface layer and the above-mentioned charge transporting material; and a method of using a polymer having charge transportability in the surface layer. The later method is preferred to obtain a photoconductor having less increase in potential after exposure process and less increase in residual potential.

The image bearing member of the present invention may be an intermediate transfer medium for use in image formation using a so-called intermediate transfer method wherein toner images formed on a photoconductor are primarily transferred to superimpose different colors and then further transferred to a transfer medium.

The intermediate transfer medium preferably has the conductivity of a volume resistivity of from $10^5$ Ω·cm to $10^{11}$ Ω·cm. When the surface volume resistivity is lower than $10^5$ Ω/square, so-called transfer dust is likely to be caused, i.e., the resulting toner images become unstable due to discharge generated when the toner images are transferred onto the intermediate transfer medium from the photoconductor. When it is higher than $10^{11}$ Ω/square, a charge counter to that held on the toner images remain on the intermediate transfer member after the toner image are transferred onto a transfer medium therefrom, which may cause image lag (a residual image) on a subsequently processed image.

As the intermediate transfer medium, for example, a belt-shaped or cylindrical plastic product which is produced by the following manner can be used. Specifically, conductive particles and/or conductive polymers composed of a metal oxide (e.g. indium oxide), carbon black or the like are used alone or in combination and kneaded with a thermoplastic resin, and the kneaded product is subjected to extrusion-molding. Besides the above method, an intermediate transfer member in the form of an endless belt can also be produced in the following manner. Specifically, the above-mentioned conductive particles and/or conductive polymers are added, when necessary, to a resin-based liquid containing a heat-crosslinkable monomer or oligomer, the materials are centrifugally molded under application of heat.

When a surface layer is formed on an intermediate transfer medium, a conductive material can be used in combination, in an appropriate amount, with a composition of materials for forming a surface layer, which are used in the photoconductor surface layer, but excluding charging transporting materials so as to control the resistivity.

Next, a toner favorably used in the present invention will be described.

The toner of the present invention preferably has an average circularity of from 0.93 to 1.00. In the present invention, a value obtained by the following (Equation 1) is defined as a circularity. The circularity is an indicator of the degree of concavo-convexes, i.e., irregularity of toner particles. The closer a toner to a true sphere, the closer the circularity to 1.00. The more complicated the surface of the circle, the smaller the circularity.

Circularity $SR$=(periphery of a circle having the same area as a particle projection area)/(periphery of a particle projection image) Equation 1

When a toner has an average circularity of from 0.93 to 1.00, the toner has smooth surface and has good transferability because of having a small contact area with another toner or a photoconductor.

Since the toner has no corner, a developer including the toner is stably stirred with a small torque in the image developing device to prevent production of abnormal images.

Since the toner does not contain toner particles having corners, a pressure is evenly applied to the toner forming dots when transferred onto the transfer medium to prevent production of hollow images.

In addition, since the toner particles have a small abrasion force because having no corner, the toner does not scratch or abrades the surface of a photoconductor.

Next, the method for measuring a circularity will be described.

The circularity can be measured using a flow type particle image analyzer, FPIA-1000 (manufactured by Toa Medical Electronics Co., Ltd.).

Specifically, the circularity of toner can be measured as follows. In 100 mL to 150 mL of water, in a vessel, from which impure solid matters are removed in advance, 0.1 mL to 0.5 mL of a surfactant, preferably alkylbenzene sulfonic acid salt is added, and about 0.1 g to about 0.5 g of a measurement sample is further added thereto. A suspension liquid in which the sample has been dispersed is subjected to a dispersion treatment in an ultrasonic disperser for about 1 min to about 3 min so that the resulting dispersion liquid has a concentration of 3,000/μL to 10,000/μL, followed by measuring the shape of the toner using the flow type particle image analyzer.

In the present invention, the toner preferably has a weight average particle diameter D4 of 3 μm to 10 μm.

Within the above-mentioned range of weight average particle diameter, the toner particles having a sufficiently small particle diameter to microscopic latent dots, and thus the toner will be excellent in dot reproducibility.

When the weight average particle diameter D4 is smaller than 3 μM, phenomena such as a reduction in transfer efficiency and degradation in blade cleanability are likely to occur.

When the weight average particle diameter D4 is greater than 10 μm, it is difficult to prevent ink-splattering in letters or characters and lines.

The toner of the present invention preferably has a ratio (D4/D1) of the weight average particle diameter D4 to a number average particle diameter D1 of 1.00 to 1.40. The closer the value of (D4/D1) to 1, the sharper the particle size distribution the toner has.

Therefore, the toner having the ratio (D4/D1) of from 1.00 to 1.40 produces stable-quality images because selection phenomena due to toner particle diameter do not take place.

Owing to the sharpness of particle size distribution, the toner has a sharp friction charged quantity distribution as well to prevent production of foggy images. Further, a toner having a uniform particle diameter has good dot reproducibility because the toner is precisely and orderly developed on a latent dot.

Next, the method for measuring a particle size distribution of toner particles will be described.

The particle size distribution of a toner can be measured by, for example, a COULTER COUNTER TA-II or COULTER MULTISIZER II (both manufactured by Coulter Electronics, Inc.) as follows:

First, in 100 mL to 150 mL of an electrolyte, 0.1 mL to 5 mL of a surfactant, preferably alkylbenzene sulfonic acid salt (which is a NaCl aqueous solution including a primary sodium content of about 1%, for example, ISOTON-II (produced by Coulter electronics, Inc.) can be used) is added as a dispersant, and 2 mg to 20 mg of a measurement sample is further added thereto. The electrolyte in which the sample has been suspended is subjected to a dispersion treatment in an ultrasonic disperser for about 1 min to about 3 min. A volume and the number of toner particles or toner are measured with each of the following channels using an aperture of 100 μm to determine a weight distribution and a number distribution. From the measured volume and number of toner particles or toner, the weight average particle diameter D4 and the number average particle diameter D1 can be determined.

The following 13 channels are used to measure particles having diameters of 2.00 μm or larger and smaller than 40.30 μm: a channel having a diameter of 2.00 μm or larger and smaller than 2.52 μm, a channel having a diameter of 2.52 μm or larger and smaller than 3.17 μm; a channel having a diameter of 3.17 μm or larger and smaller than 4.00 μm; a channel having a diameter of 4.00 μm or larger and smaller than 5.04 μm; a channel having a diameter of 5.04 μM or larger and smaller than 6.35 μm; a channel having a diameter of 6.35 μm or larger and smaller than 8.00 μm; a channel having a diameter of 8.00 μM or larger and smaller than 10.08 μm; a channel having a diameter of 10.08 μm or larger and smaller than 12.70 μm; a channel having a diameter of 12.70 μm or larger and smaller than 16.00 μm; a channel having a diameter of 16.00 μm or larger and smaller than 20.20 μm; a channel having a diameter of 20.20 μm or larger and smaller than 25.40 μm; a channel having a diameter of 25.40 μm or larger and smaller than 32.00 μm; and a channel having a diameter of 32.00 μm or larger and smaller than 40.30 μm.

Such a substantially spherical-shape toner is preferably a toner which is produced in the following procedure. A toner composition containing a polyester prepolymer having a functional group containing a nitrogen atom, a polyester, a colorant and a releasing agent is subjected to a crosslinking and/or elongation reaction in the presence of resin fine particles in an aqueous medium. The toner produced by the reaction can reduce hot offset by curing the toner surface, and makes it possible to reduce contamination in the fixing device to appear on formed images.

As the prepolymer formed of a modified polyester-based resin, which can be used in production of toner of the present invention, a polyester prepolymer (A) having an isocyanate group is exemplified. As the compound to be elongated and/or crosslinked with the prepolymer, amines (B) are exemplified.

The polyester prepolymer having an isocyanate group (A) is formed from a reaction between polyester having an active hydrogen atom formed by polycondensation between a polyol (1) and a polycarboxylic acid (2), and polyisocyanate (3). Specific examples of the active hydrogen possessed by the polyester include a hydroxyl group (an alcoholic hydroxyl group and a phenolic hydroxyl group), an amino group, a carboxyl group, and a mercapto group. In particular, the alcoholic hydroxyl group is preferably used.

As the polyol (1), diol (1-1) and polyols having 3 valences or more (1-2) can be used, and (1-1) alone or a mixture of (1-1) and a small amount of (1-2) are preferably used. Specific examples of diol (1-1) include alkylene glycols (e.g. ethylene glycol, 1,2-propylene glycol, 1,3-propylene glycol, 1,4-butanediol, and 1,6-hexanediol, etc.); alkylene ether glycols (e.g. diethylene glycol, triethylene glycol, dipropylene glycol, polyethylene glycol, polypropylene glycol and polytetramethylene ether glycol, etc.); alicyclic diols (e.g. 1,4-cyclohexanedimethanol and hydrogenated bisphenol A, etc.); bisphenol (e.g. bisphenol A, bisphenol F and bisphenol S, etc.); adducts of the above-mentioned alicyclic diol with an alkylene oxide (e.g. ethylene oxide, propylene oxide and butylene oxide, etc.); and adducts of the above-mentioned bisphenol with an alkylene oxide (e.g. ethylene oxide, propylene oxide and butylene oxide, etc.). Among these, preferred are an alkylene glycol having 2 to 12 carbon atoms and adducts of bisphenol with an alkylene oxide, with adducts of the bisphenol with an alkylene oxide, and combinations of the alkylene glycol having 2 to 12 carbon atoms with the adducts being particularly preferred. Specific examples of the polyol having 3 valences (1-2) include polyhydric aliphatic alcohols having 3 to 8 or more valences (e.g. glycerin, trimethylolethane, trimethylolpropane, pentaerythritol and sorbitol, etc.); phenols having 3 or more valences (e.g. trisphenol PA, phenol novolak, cresol novolak, etc.); and adducts of the above-mentioned polyphenol having 3 or more valences with an alkylene oxide.

As the polycarboxylic acid (2), dicarboxylic acids (2-1) and polycarboxylic acids having 3 or more valences (2-2) can be used. (2-1) alone, or a mixture of (2-1) and a small amount of (2-2) are preferably used. Specific examples of the dicarboxylic acid (2-1) include alkylene dicarboxylic acids such as succinic acid, adipic acid and sebacic acid; alkenylene dicarboxylic acids such as maleic acid and fumaric acid; and aromatic dicarboxylic acids such as phthalic acid, isophthalic acid, terephthalic acid and naphthalene dicarboxylic acid. In particular, an alkenylene dicarboxylic acid having 4 to 20 carbon atoms and an aromatic dicarboxylic acid having 8 to 20 carbon atoms are preferably used. Specific examples of the polycarboxylic acid having 3 or more valences (2-2) include aromatic polycarboxylic acids having 9 to 20 carbon atoms (e.g. trimellitic acid and pyromellitic acid, etc.). The polycarboxylic acid (2) can be formed from a reaction between one or more of the polyols (1) and an anhydride or lower alkyl ester (e.g. methyl esters, ethyl esters and isopropyl esters, etc.) of one or more of the above-mentioned acids.

The polyol (1) and polycarboxylic acid (2) are mixed such that an equivalent ratio ([OH]/[COOH]) of a hydroxyl group [OH] to a carboxylic group [COOH] is typically from 2/1 to 1/1, preferably from 1.5/1 to 1/1, and more preferably from 1.3/1 to 1.02/1.

Specific examples of the polyisocyanate (3) include aliphatic polyisocyanates (e.g. tetramethylenediisocyanate, hexamethylenediisocyanate and 2,6-diisocyanatemethylcaproate, etc.); alicyclic polyisocyanates (e.g. isophoronediisocyanate and cyclohexylmethanediisocyanate, etc.); aromatic diisocyanates (e.g. tolylenedisocyanate and diphenylmethanediisocyanate, etc.); aromatic aliphatic diisocyanates (e.g. α,α,α',α'-tetramethylxylylenediisocyanate; isocyanurates; the above-mentioned polyisocyanates blocked with phenol derivatives, oxime, caprolactam or the like; and combinations thereof.

The polyisocyanate (3) is mixed with polyester such that an equivalent ratio ([NCO]/[OH]) of an isocyanate group [NCO] to polyester having a hydroxyl group [OH] is typically from 5/1 to 1/1, preferably from 4/1 to 1.2/1 and more preferably from 2.5/1 to 1.5/1. When the ratio [NCO]/[OH] is greater than 5, low-temperature fixability of the resultant toner degrades. When [NCO] has a molar ratio less than 1, the urea content in ester of the modified polyester decreases and hot offset resistance of the resultant toner degrades. The amount of the constitutional component of a polyisocyanate (3) in the polyester prepolymer (A) having a polyisocyanate group at its end is from 0.5% by weight to 40% by weight, preferably from 1% by weight to 30% by weight and more preferably from 2% by weight to 20% by weight. When the amount is less than 0.5% by weight, the hot offset resistance of the resultant toner degrades, and the toner has difficulty in concurrently satisfying heat resistance and low-temperature fixability. In contrast, when the amount is greater than 40% by weight, the low-temperature fixability of the resultant toner degrades.

The number of the isocyanate groups contained in a molecule of the polyester prepolymer (A) is typically 1 or more, preferably from 1.5 to 3 on average, and more preferably from 1.8 to 2.5 on average. When the number of isocyanate groups is less than 1 per molecule, the molecular weight of the urea-modified polyester decreases and hot offset resistance of the resultant toner degrades.

Specific examples of the amines (B) include diamines (B1), trivalent or higher polyvalent polyamines (B2), amino alcohols (B3), amino mercaptans (B4), amino acids (B5) and blocked amines (B6) in which the amino groups in the amines (B1) to (B5) are blocked. Specific examples of the diamines (B1) include aromatic diamines (e.g. phenylene diamine, diethyltoluene diamine and 4,4'-diaminodiphenyl methane; alicyclic diamines (e.g. 4,4'-diamino-3,3'-dimethyldicyclohexyl methane, diaminocyclohexane and isophoronediamine, etc.); aliphatic diamines (e.g. ethylene diamine, tetramethylene diamine and hexamethylene diamine, etc.). Specific examples of the trivalent or higher polyvalent polyamines (B2) include diethylenetriamine, triethylenetetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propionic acid and amino caproic acid. Specific examples of the blocked amines (B6) include ketimine compounds which are prepared by reacting one of the amines (B1) to (B5) with a ketone (e.g. acetone, methyl ethyl ketone and methyl isobutyl ketone); and oxazoline compounds. Among these amines (B), preferred are diamines (B1) and mixtures in which a diamine (B1) is mixed with a small amount of a polyamine (B2).

The molecular weight of the urea-modified polyesters' can optionally be controlled using an elongation anticatalyst, if desired. Specific examples of the elongation anticatalyst include monoamines (e.g. diethyl amine, dibutyl amine, butyl amine and lauryl amine, and blocked amines (i.e., ketimine compounds prepared by blocking the monoamines mentioned above).

A mixing ratio of the amount of the prepolymer (A) having an isocyanate group to the amine (B) (i.e. an equivalent ratio [NCO]/[NHx] of an isocyanate group [NCO] to an amino group [NHx]) is from 1/2 to 2/1, preferably from 1.5/1 to 1/1.5 and more preferably from 1.2/1 to 1/1.2. When the mixing ratio is greater than 2' or less than ½, the molecular weight of the urea-modified polyester (i) decreases, resulting in degradation of hot offset resistance of the resultant toner. In the present invention, the urea-modified polyester (i) may contain a urethane bonding as well as a urea bonding. A molar ratio (urea/urethane) of the urea bonding to the urethane bonding is from 100/0 to 10/90, preferably from 80/20 to 20/80 and more preferably from 60/40 to 30/70. When the molar ratio of the urea bonding is less than 10%, hot offset resistance of the resultant toner degrades.

Through the above-mentioned reactions, the modified polyester for use in the present invention, in particular, a urea-modified polyester (i) can be prepared. The urea-modified polyester (i) can be prepared by a method such as a one-shot method or a prepolymer method. The weight average molecular weight of the urea-modified polyester (i) is 10,000 or more, preferably from 20,000 to 10,000,000 and still more preferably from 30,000 to 1,000,000. When the weight-average molecular weight is less than 10,000, hot offset resistance of the resultant toner degrades. The number average molecular weight of the urea-modified polyester is not particularly limited when the after-mentioned unmodified polyester resin is used in combination, provided that the above-mentioned weight average molecular weight can be easily obtained. Namely, the weight-average molecular weight of the urea-modified polyester (i) has priority over the number average molecular weight thereof when combined with an unmodified polyester (ii) mentioned later. However, when the urea-modified polyester (i) is used alone, the number average molecular weight is 20,000 or less, preferably from 1,000 to 10,000 and more preferably from 2,000 to 8,000. When the number average molecular weight is more than 20,000, the low temperature fixability of the resultant toner degrades, and in addition the glossiness of full color images degrades.

In the present invention, an unmodified polyester resin (ii) can be used in combination with the urea-modified polyester resin (i) as a toner binder resin. It is more preferable to use the unmodified polyester resin (ii) in combination with the modified polyester resin than to use the urea-modified polyester resin alone, because low-temperature fixability and glossiness of full color images of the resultant toner improve. Specific examples of the unmodified polyester resin (ii) include polycondensed products between the polyol (1) and polycarboxylic acid (2) similarly to the urea-modified polyester resin (i), and the components preferably used are the same as those thereof. It is preferable that the urea-modified polyester resin (i) and unmodified polyester resin (ii) are partially soluble with each other in terms of the low-temperature fixability and hot offset resistance of the resultant toner. Therefore, the urea-modified polyester resin (i) and unmodified polyester resin (ii) preferably have similar compositions. When the unmodified polyester resin (ii) is used in combination, a weight ratio ((i)/(ii)) of the urea-modified polyester resin (i) to the unmodified polyester resin (ii) is from 5/95 to 80/20, preferably from 5/95 to 30/70, more preferably from 5/95 to 25/75, and particularly preferably from 7/93 to 20/80. When the urea-modified polyester resin (i) has a weight ratio less than 5%, the resultant toner has poor hot offset resistance, and has difficulty in concurrently satisfying heat resistant storage stability and low-temperature fixability.

The unmodified polyester resin (ii) preferably has a peak molecular weight of from 1,000 to 30,000, preferably from 1,500 to 10,000, and more preferably from 2,000 to 8,000. When the peak molecular weight is less than 1,000, the heat resistant storage stability of the resultant toner degrades. When it is more than 10,000, the low-temperature fixability thereof degrades. The unmodified polyester resin (ii) preferably has a hydroxyl value of 5 mgKOH/g or higher, more preferably of from 10 mgKOH/g to 120 mgKOH/g, and particularly preferably from 20 mgKOH/g to 80 mg KOH/g. When it is less than 5 mgKOH/g, the resultant toner has difficulty in concurrently satisfying heat resistant storage stability and low-temperature fixability. The unmodified polyester resin (ii) has an acid value of from 1 mgKOH/g to 30 mgKOH/g, and more preferably from 5 mgKOH/g to 20 mgKOH/g such that the resultant toner tends to be negatively charged.

In the present invention, the glass transition temperature (Tg) of the binder resin is usually 50° C. to 70° C., and preferably 55° C. to 65° C. When the Tg is lower than 50° C., the blocking resistance of the resulting toner degrades during storage at high temperature. When the Tg is higher than 70° C., the low-temperature fixability becomes insufficient. Even when the glass transition temperature (Tg) of the binder resin is relatively low, the dry-process toner of the present invention tends to have excellent heat resistant storage stability because of the combined use of the urea-modified polyester resin, as compared to conventionally known polyester-based toners. The binder resin usually has a temperature (TG') at which a storage modulus of the toner binder resin is 10,000 dyne/cm$^2$ at a measuring frequency of 20 Hz, of 100° C. or higher, and preferably of from 110° C. to 200° C. When the temperature is lower than 100° C., the hot offset resistance of the resultant toner degrades. The binder resin preferably has a temperature (Tη) at which the viscosity is 1,000 poises at a measuring frequency of 20 Hz, of 180° C. or lower, and more preferably of from 90° C. to 160° C. When the temperature is higher than 180° C., the low-temperature fixability of the resultant toner degrades. Namely, TG' is preferably higher than Tη in terms of the low-temperature fixability and hot offset resistance of the resultant toner. In other words, the difference of TG' minus Tη (TG'-Tη) is preferably 0° C. or more, more preferably 10° C. or more, and particularly preferably 20° C. or more. The maximum difference is not particularly limited. In terms of the heat resistant storage stability and low-temperature fixability of the resultant toner, the difference of TG' minus Tη (TG'-Tη)) is preferably from 0° C. to 100° C., more preferably from 10° C. to 90° C., and particularly preferably from 20° C. to 80° C.

The binder resin can be prepared, for example, by the following method. The polyol (1) and polycarboxylic acid (2) are heated at a temperature of from 150° C. to 280° C. in the presence of a known esterifying catalyst such as tetrabutoxy titanate and dibutyltin oxide. Then, water generated is removed, under a reduced pressure if desired, to prepare a polyester resin having a hydroxyl group. Then the polyester resin is reacted with the polyisocyanate (3) at a temperature of from 40° C. to 140° C. to obtain a prepolymer (A) having an isocyanate group. Further, the prepolymer (A) is reacted with an amine (B) at a temperature of from 0° C. to 140° C. to obtain a urea-modified polyester. When the prepolymer (A) and amine (B) are reacted with the polyisocyanate (3), a solvent can also be used if desired. Suitable solvents include solvents which do not react with (PIC). Specific examples of such solvents include aromatic solvents (e.g. toluene and xylene); ketones (e.g. acetone, methyl ethyl ketone and methyl isobutyl ketone); esters (e.g. ethyl acetate); amides (e.g. dimethylformamide and dimethylacetamide); ethers (e.g. tetrahydrofuran). When the unmodified polyester (ii) (i.e. a polyester not modified with urea bonds) is used in combination with the urea-modified polyester (i), a method similar to a method for preparing a polyester resin having a hydroxyl group is used to prepare the unmodified polyester (ii), and which dissolved and mixed in a solution after a reaction of the urea-modified polyester (i) is completed.

The toner can be prepared by, but is not limited to, the following method.

The aqueous medium may include water alone, and a mixture of water with a water-miscible solvent. Specific examples of the solvent include alcohols (e.g. methanol, isopropanol and ethylene glycol,); dimethylformamide; tetrahydrofuran; cellosolves (e.g. methyl cellosolve); and lower ketones (e.g. acetone and methyl ethyl ketone).

The toner may be prepared by reacting a dispersion including the prepolymer having an isocyanate group (A) with the amine (B) in an aqueous medium, or may use a previously-prepared urea-modified polyester (i). As a' method of stably preparing a dispersion formed of the urea-modified polyester (i) and the prepolymer (A) in an aqueous medium, a method of adding a toner composition formed of the urea-modified polyester (i) and the prepolymer (A) into an aqueous medium and dispersing these components upon application of shear stress is preferably used. The prepolymer (A), and other toner components (hereinafter referred to as toner materials) such as colorants, master batch pigments, releasing agents, charge controlling agents and unmodified polyester resins etc. may be added into an aqueous medium at the same time when the dispersion is prepared. However, it is preferable that the toner materials are previously mixed, and then are added to the aqueous medium. In addition, in the present invention, other toner materials such as colorants, releasing agents, charge controlling agents, etc., are not necessarily added to the aqueous dispersion before particles are formed, and may be added thereto after particles are prepared in the aqueous medium. For example, after forming particles without colorants, a colorant can also be added thereto by known dying methods.

The dispersion method is not particularly limited, and low-speed shearing methods, high-speed shearing methods, friction methods, high-pressure jet methods, ultrasonic methods, etc. can be used. Among these methods, high-speed shearing methods are preferably used because particles having a particle diameter of from 2 μm to 20 μm can be easily prepared. When a high-speed shearing type dispersing device is used, the rotation speed is not particularly limited, but the rotation speed is typically from 1,000 rpm to 30,000 rpm, and preferably from 5,000 rpm to 20,000 rpm. The dispersion time is not also particularly limited, but is typically from 0.1 min to 5 min. The temperature in the dispersion process is typically from 0° C. to 150° C. (under pressure), and preferably from 40° C. to 98° C. When the temperature is relatively high, the urea-modified polyester (i) and prepolymer (A) can easily be dispersed because the dispersion formed thereof has a low viscosity.

The amount of the aqueous medium per 100 parts by weight of the toner composition containing the prepolymer (A) and the urea-modified polyester (i) is typically from 50 parts by weight to 2,000 parts by weight, and preferably from 100 parts by weight to 1,000 parts by weight. When the amount of the aqueous medium is less than 50 parts by weight, the dispersion stability of the toner composition is not satisfactory, and thereby the resultant toner particles do not have a desired particle diameter. In contrast, when the amount is more than 20,000 parts by weight, the production cost increases. A dispersant can also be preferably used to prepare a stably dispersed dispersion including particles having a sharp particle size distribution.

The urea-modified polyester (i) may be synthesized from the prepolymer (A) by adding amines (B) in the aqueous medium before the toner composition is dispersed therein or after the toner composition dispersed therein so as to initiate a reaction from the interface of particles. The urea-modified polyester (i) is preferentially formed on the surface of the resultant toner, and which can have a gradient of concentration thereof inside.

Specific preferred examples of the dispersants used to emulsify and disperse an oil phase in an aqueous liquid in which the toner composition is dispersed, include anionic surfactants such as alkylbenzene sulfonic acid salts, .α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and amphoteric surfactants such as alanine, dodecyldi(aminoethyl)glycin, di(octylaminoethyl)glycin, and N-alkyl-N,N-dimethylammonium betaine.

A surfactant having a fluoroalkyl group can be used to prepare a dispersion having excellent dispersibility even when a small amount of the surfactant is used. Specific examples of anionic surfactants having a fluoroalkyl group include fluoroalkyl carboxylic acids having from 2 to 10 carbon atoms and metal salts thereof, disodium perfluorooctanesulfonylglutamate, sodium 3-{omega-fluoroalkyl (C6-C11) oxy}-1-alkyl (C3-C4) sulfonate, sodium 3-{omega-fluoroalkanoyl (C6-C8)-N-ethylamino}-1-propane sulfonate, fluoroalkyl (C11-C20) carboxylic acids and metal salts thereof, perfluoroalkylcarboxylic acids (C7 to C13) and metal salts thereof, perfluoroalkyl (C4-C12) sulfonate and metal salts thereof, perfluorooctanesulfonic acid diethanol amides, N-propyl-N-(2-hydroxyethyl)perfluorooctanesulfone amide, perfluoroalkyl (C6-C10) sulfoneamidepropyl trimethyl ammonium salts, salts of perfluoroalkyl (C6-C10)-N-ethylsulfonyl glycin, and monoperfluoroalkyl (C6-C16) ethylphosphate.

Specific examples of the commercially available products of such surfactants having a fluoroalkyl group include SURFLON S-111, S-112 and S-113 (produced by Asahi Glass Co., Ltd.); FRORARD FC-93, FC-95, FC-98 and FC-129 (produced by Sumitomo 3M Ltd.); UNIDYNE DS-101 and DS-102 (produced by Daikin Industries, Ltd.); MEGAFACE F-110, F-120, F-113, F-191, F-812 and F-833 (produced by Dainippon Ink and Chemicals, Inc.); ECTOP EF-102, 103, 104, 105, 112, 123A, 123B, 306A, 501, 201 and 204 (produced by Tohchem Products Co., Ltd.); and FUTARGENT F-100 and F150 (produced by Neos).

Specific examples of the cationic surfactants include primary, secondary and tertiary aliphatic amines having a fluoroalkyl group, aliphatic quaternary ammonium salts such as perfluoroalkyl (C6-C10) sulfoneamidepropyl trimethyl ammonium salts, benzalkonium salts, benzethonium chloride, pyridinium salts, imidazolinium salts, etc. Specific examples of commercially available products thereof include SURFLON S-121 (produced by Asahi Glass Co., Ltd.); FRORARD FC-135 (produced by Sumitomo 3M Ltd.); UNIDYNE DS-202 (produced by Daikin Industries, Ltd.); MEGAFACE F-150 and F-824 (produced by Dainippon Ink and Chemicals, Inc.); ECTOP EF-132 (produced by Tohchem Products Co., Ltd.); FUTARGENT F-300 (produced by Neos).

In addition, inorganic compound dispersants such as tricalcium phosphate, calcium carbonate, titanium oxide, colloidal silica and hydroxyapatite, which are hardly soluble in water, can also be used.

Further, it is possible to stably disperse a toner composition in water using a polymeric protection colloid. Specific examples of such protection colloids include polymers and copolymers prepared using monomers such as acids (e.g. acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g. β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, β-chloro-2-hydroxypropyl acrylate, 3-chloro-2-hydroxypropyl methacrylate, diethylene glycol monoacrylic acid esters, diethylene glycol monomethacrylic acid esters, glycerin monoacrylic acid esters, N-methylolacrylamide and N-methylolmethacrylamide), vinyl alcohol and ethers thereof (e.g. vinyl methyl ether, vinyl ethyl ether and vinyl propyl ether), esters of vinyl alcohol with a compound having a carboxyl group (i.e. vinyl acetate, vinyl propionate and vinyl butyrate); acrylic amides (e.g. acrylamide, methacrylamide and diacetoneacrylamide) and their methylol compounds, acid chlorides (e.g. acrylic acid chloride and methacrylic acid chloride), and homopolymers and copolymers having a nitrogen atom or a heterocyclic ring having a nitrogen atom (e.g. vinyl pyridine, vinyl pyrrolidone, vinyl imidazole and ethylene imine). In addition, the following can also be used as the polymeric protective colloid: polyoxyethylene compounds (e.g. polyoxyethylene, polyoxypropylene, polyoxyethylene alkyl amine, polyoxypropylene alkyl amine, polyoxyethylene alkyl amide, polyoxypropylene alkyl amides, polyoxyethylene nonylphenyl ethers, polyoxyethylene laurylphenyl ether, polyoxyethylene stearylphenyl ester, and polyoxyethylene nonylphenyl ester); and cellulose compounds such as methyl cellulose, hydroxyethyl cellulose and hydroxypropyl cellulose.

When an acid such as calcium phosphate or a material soluble in alkaline is used as a dispersant, the calcium phosphate is dissolved with an acid such as a hydrochloric acid and washed with water to remove the calcium phosphate from the toner particle. Besides this method, it can also be removed by an enzymatic hydrolysis.

When a dispersant is used, the dispersant may remain on a surface of the toner particle. However, the dispersant is preferably washed and removed after the elongation and/or crosslinking reaction of the prepolymer with amine in terms of chargeability of the resultant toner.

Further, to decrease viscosity of a dispersion medium including the toner composition, a solvent which can dissolve the urea-modified polyester resin (i) and prepolymer (A) can be used because the resultant particles have a sharp particle size distribution. The solvent is preferably volatile from the viewpoint of being easily removed from the dispersion after the particles are formed. Specific examples of such a solvent include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents may be used alone or in combination. Among these solvents, aromatic solvents such as toluene and xylene; and halogenated hydrocarbons such as methylene chloride, 1,2-dichloroethane, chloroform, and carbon tetrachloride are preferably used. The addition amount of such a solvent is from 0 parts to 300 parts, preferably from 0 parts to 100 parts, and more preferably from 25 parts to 70 parts, per 100 parts of the prepolymer (A) used. When such a solvent is used to prepare a particle dispersion, the solvent is removed therefrom under a normal or reduced pressure after the particles are subjected to an elongation reaction and/or a crosslinking reaction of the prepolymer with amine.

The elongation and/or crosslinking reaction time depends on reactivity of the isocyanate structure of the prepolymer (A) and amine (B), but is typically from 10 minutes to 40 hours, and preferably from 2 hours to 24 hours. The reaction temperature is typically from 0° C. to 150° C., and preferably from 40° C. to 98° C. In addition, a known catalyst such as dibutyltinlaurate and dioctyltinlaurate can be used if necessary.

To remove an organic solvent from the emulsified dispersion, it is possible to employ a method of gradually raising the temperature of the whole dispersion to completely remove the organic solvent in the droplet by vaporizing. Alternatively, a method of spraying the emulsified dispersion in dry air, completely removing a water-insoluble organic solvent from the droplet to form toner particles and removing the water dispersant by vaporizing can also be used. As the dry air, atmospheric air, nitrogen gas, carbon dioxide gas, a gaseous body in which a combustion gas is heated, and particularly various aerial currents heated to have a temperature not less than a boiling point of the solvent used are typically used. A spray dryer, a belt dryer and a rotary kiln can sufficiently remove the organic solvent in a short time.

When the emulsified dispersion is washed and dried while maintaining a wide particle size distribution thereof, the dispersion can be classified to have a desired particle size distribution.

A cyclone, a decanter, a centrifugal separation, etc. can remove fine particles in a dispersion liquid. The powder remaining after the dispersion liquid is dried can be classified, but the liquid is preferably classified in terms of efficiency. Unnecessary fine and coarse particles can be recycled to a kneading process to form particles. The fine and coarse particles may be wet when recycled.

The dispersant is preferably removed from the dispersion liquid, and more preferably removed at the same, time when the above-mentioned classification is performed.

Heterogeneous particles such as releasing agent particles, charge controlling particles, fluidizing particles and colorant particles can be mixed with the toner powder after drying. Release of the heterogeneous particles from composite particles can be prevented by giving a mechanical stress to a mixed powder to fix and fuse them on a surface of the composite particles.

Specific methods include a method of applying an impact force on the mixture with a blade rotating at high-speed, a method of putting a mixture in a high-speed stream and accelerating the mixture such that particles thereof collide with each other or composite particles thereof collide with a collision board, etc. Specific examples of the device for use in this stage include an ONG MILL (from Hosokawa Micron Corp.), a modified I-type mill having a lower pulverizing air pressure (from Nippon Pneumatic Mfg. Co., Ltd.), a hybridization system (from Nara Machinery Co., Ltd.), a Kryptron System (from Kawasaki Heavy Industries, Ltd.), an automatic mortar, etc.

Known pigments and dyes having been used as colorants for toners can be used as colorants for use in the toner of the present invention. Specific examples of the colorants include carbon black, lamp black, iron black, cobalt blue, nigrosine dyes, aniline blue, phthalocyanine blue, phthalocyanine green, Hansa Yellow G, Rhodamine 6C Lake, chalco oil blue, chrome yellow, quinacridone red, benzidine yellow, rose Bengal. These can be used alone or in combination.

Further, to optionally impart magnetism to toner particles, magnetic components, i.e., iron oxides such as ferrite, magnetite and maghemite; metals such as iron, cobalt and nickel; or their alloyed metals with other metals are included in toner particles alone or in combination. In addition, these components can be used as colorants or with colorants.

The colorant in the toner of the present invention preferably has a number average particle diameter of 0.5 μm or smaller, more preferably 0.4 μm or smaller, and still more preferably 0.3 μm or smaller.

When the number average particle diameter of the colorant is greater than 0.5 μm, the colorant does not have a sufficient dispersibility and the resultant toner does not have desired transparency.

The colorant having a particle diameter smaller than 0.1 μm is basically considered not to have an adverse effect on light reflection and absorption of the resultant toner. The colorant having a particle diameter smaller than 0.1 μm contributes to transparency of an OHP sheet having good color reproducibility and image fixability. To the contrary, a large number of the colorants having a particle diameter greater than 0.5 μm tend to essentially degrade brightness and chromaticness of a projected image on an OHP sheet.

Meanwhile, a large number of the colorants having a particle diameter greater than 0.5 μm are released from a surface of the toner particle, and tend to cause various problems such as fogging, drum contamination and cleaning defects. The colorant having a number average particle diameter greater than 0.7 μm is preferably 10% by number or less, and more preferably 5% by number or less, to the percent by number of all colorants used.

When the colorant is previously kneaded with a part or all of binder resins under the presence of a wetter, the colorant and the binder resins sufficiently adhere to each other and the colorant is effectively and stably dispersed even after any production process. The resultant toner includes well dispersed colorant, a small dispersion diameter thereof and has good transparency.

Specific examples of the binder resin include, but are not limited to, the resins as toner binder resins mentioned above.

Specific examples of the method of previously kneading a mixture of the binder resin, the colorant and the wetter include a method of mixing the binder resin, the colorant and the wetter by a blender such as HENSCHEL MIXER; and kneading the mixture by a kneader such as two-roll and three-roll mills at a lower temperature than a melting point of the binder resin to thereby obtain a sample.

The wetter can be selected from among typical ones in consideration of solubility with the binder resin and wettability of the colorant. Particularly, organic solvents such as acetone, toluene, butanone or water are preferably used in terms of dispersibility of the colorant.

Water is most preferably used in terms of environmental protection and the dispersion stability of the colorant in the following process of preparing a toner.

This method not only makes the colorant have a small particle diameter but also increase uniformity of the dispersion status thereof, and which improves color reproducibility of images projected by OHP more.

The toner may contain a releasing agent typified by a wax together with a toner binder and a colorant.

Specific examples of the releasing agent include known releasing agents, e.g. polyolefin waxes (polyethylene wax and polypropylene wax, etc.); long chain carbon hydrides (paraffin wax and Sasol Wax, etc.); and waxes containing a carbonyl group.

Among these waxes, the waxes containing a carbonyl group are preferably used. Specific examples thereof include polyester alkanate (carnauba wax, montan wax, trimethylol propane tribehenate, pentaerythritol tetrabehenate, pentaerythritol diacetate dibehenate, glycerine tribehenate and 1,18-octadecanedioldistearate, etc.); polyalkanol esters (tristearyl trimellitate and distearyl maleate, etc.); polyamide alkanate (ethylenediamine behenylamide, etc.); polyalkylamide (tristearylamide trimellitate, etc.); and dialkyl ketone (distearyl ketone, etc.).

Among these waxes containing a carbonyl group, polyester alkanate is preferably used. The releasing agent (wax) for use in the present invention usually has a melting point of from 40° C. to 160° C., preferably of from 50° C. to 120° C. and more preferably of from 60° C. to 90° C. A wax having a melting point less than 40° C. has an adverse effect on heat resistant storage stability, and a wax having a melting point greater than 160° C. tends to cause cold offset of the resultant toner when fixed at a low temperature. In addition, the wax preferably has a melting viscosity of from 5 cps to 1,000 cps, and more preferably of from 10 cps to 100 cps when measured at a temperature higher than the melting point by 20° C. A wax having a melting viscosity greater than 1,000 cps makes it difficult to improve hot offset resistance and low temperature fixability of the resultant toner. The amount of the wax in a toner is preferably from 0% by weight to 40% by weight, and more preferably from 3% by weight to 30% by weight.

The toner may include a charge controlling agent to obtain sufficient charge amount and improve charge buildability. Materials almost colorless or white are preferably used because colored materials cause a color change of the resultant toner.

Specific examples of the charge controlling agent include known charge controlling agents such as triphenylmethane dyes, chelate compounds of molybdic acid, Rhodamine dyes, alkoxy amines, quaternary ammonium salts (including fluorine-modified quaternary ammonium salts), alkylamides, phosphor or compounds including phosphor, tungsten or compounds including tungsten, fluorine-containing activators, metal salts of salicylic acid, and salicylic acid derivatives. Specific examples of commercially available products of the charge controlling agents include BONTRON P-51 (quaternary ammonium salt), E-82 (metal complex of oxynaphthoic acid), E-84 (metal complex of salicylic acid), and E-89 (phenolic condensation product), which are produced by Orient Chemical Industries Co., Ltd.; TP-302 and TP-415 (molybdenum complex of quaternary ammonium salt), which are produced by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are produced by Hoechst AG; LRA-901, and LR-147 (boron complex), which are produced by Japan Carlit Co., Ltd.; copper phthalocyanine, perylene, quinacridone, azo pigments and polymers having a functional group such as a sulfonate group, a carboxyl group, a quaternary ammonium group, etc.

The amount of the charge controlling agent is determined depending on the species of the binder resin used, whether or not an additive is added and toner production method (such as dispersion method) used, and is not unequivocally defined. However, the amount of the charge controlling agent is typically from 0.1 parts by weight to 10 parts by weight, and preferably from 0.2 parts by weight to 5 parts by weight, per 100 parts by weight of the binder resin contained in the toner. When the amount of the charge controlling agent is more than 10 parts by weight, the toner has too large charge amount, and thereby the electrostatic force of a developing roller attracting the toner increases, resulting in degradation of the flowability of the toner and decrease of the image density of toner images. The charge controlling agent can be dissolved and dispersed after kneaded upon application of heat together with a master batch pigment and resin, can be added when directly dissolved and dispersed in an organic solvent or can be fixed on a toner surface after the toner particles are produced.

Resin particles may be added in an aqueous medium when the toner composition is dispersed therein to stabilize the dispersibility. Any thermoplastic, and thermosetting resins can be used provided that these resins can form an aqueous dispersion. Specific examples of the resins include vinyl resins, polyurethane resins, epoxy resins, polyester resins, polyamide resins, polyimide resins, silicon resins, phenol resins, melamine resins, urea resins, aniline resins, ionomer resins and polycarbonate resins. These resins can be used in combination. Among these resins, vinyl resins, polyurethane resins, epoxy resins, polyester resins and their combinations are preferably used because an aqueous medium including spherical particulate resins can easily be formed.

Specific examples of the vinyl resins include, but are not limited to, polymers formed of homopolymerized or copolymerized vinyl monomers such as styrene-(metha) acrylate resins, styrene-butadiene copolymers, (metha)acrylic acid-acrylate polymers, styrene-acrylonitrile copolymers, styrene-maleic acid anhydride copolymers and styrene-(metha) acrylic acid copolymers.

As an external additive for improving flowability, developability and chargeability of the colored particles of the present invention, inorganic particulate materials are preferably used. The inorganic particulate materials preferably have a primary particle diameter of from 5 nm to 2 μm, and more preferably from 5 nm to 500 nm. In addition, a specific surface area of the inorganic particulate materials measured by a BET method is preferably from 20 $m^2/g$ to 500 $m^2/g$. The amount of the external additive is preferably from 0.01% by weight to 5% by weight, and more preferably from 0.01% by weight to 2.0% by weight, based on total weight of the toner composition. Specific examples of the inorganic particulate materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride.

Besides these materials, particulate polymers such as polystyrene formed by a soap-free emulsifying polymerization, a suspension polymerization or a dispersion polymerization, methacrylate or acrylate copolymers, silicone resins, benzoguanamine resins, polycondensation particulate materials such as nylon and polymer particles of thermosetting resins can be used.

These flowability improvers, i.e., surface treatment agents can increase hydrophobicity and prevent degradation of flowability and chargeability of the resultant toner even under high humidity environment. Specific preferred examples of the surface treatment agents include silane coupling agents, silylation agents silane coupling agents having an alkyl fluoride group, organic titanate coupling agents, aluminum coupling agents silicone oils and modified silicone oils.

The toner may include a cleanability improver for removing a developer remaining on a photoconductor and an intermediate transfer medium after transferred. Specific examples of the cleanability improver include fatty acid metallic salts such as zinc stearate, calcium stearate and stearic acid; and polymer fine particles prepared by a soap-free emulsifying polymerization method such as polymethylmethacrylate fine particles and polystyrene fine particles. The polymer fine particles comparatively have a narrow particle size distribution and preferably have a volume-average particle diameter of from 0.01 μm to 1 μm.

With use of the toner, high-quality toner images can be formed with excellent in developing stability. However, the toner remaining on an image bearing member, which has not been transferred onto a transfer medium or an intermediate transfer medium, occasionally passes a cleaning device because it is difficult to remove therewith due to its fineness and rollability. It is necessary to strongly press a toner removal member such as a cleaning blade to the image bearing member to completely remove the toner therefrom. Such a load not only shortens lives of the image bearing member and the cleaning device but also consumes extra energy.

When a load to the image bearing member is reduced, a toner thereon and a carrier having a small particle diameter thereon are not sufficiently removed therefrom, and which scratch the surface thereof when passing the cleaning device, resulting in degradation in image-forming performance of the image forming apparatus.

As described above, the image forming apparatus of the present invention is capable of highly preventing variation of the surface conditions of a photoconductor, particularly a low-resistivity part thereof, and variation of chargeability thereto, and thus it is possible to produce high-quality images for a long period of time when using the toner.

In addition, the image forming apparatus of the present invention can use not only the toner suitable for obtaining high-quality images but also can use an amorphous toner prepared by pulverization methods as well.

Constituents forming the toner prepared by the pulverization methods include those typically used in the electrophotographic toners without particular limitations.

Specific examples of the binder resin for use in the toner include styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butylmethacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; acrylic ester polymers and copolymers such as polymethyl acrylate, polybutyl acrylate, polymethyl methacrylate and polybutyl methacrylate; polyvinyl derivatives such as polyvinylchloride and polyvinyl acetate; polyester polymers; polyurethane polymers; polyamide polymers; polyimide polymers; polyol polymers; epoxy polymers; terpene polymers; aliphatic or alicyclic hydrocarbon resins; and aromatic petroleum resins. These can be used alone or in combination, but the resins are not limited thereto. Among these resins, at least one resin selected from the group consisting of styrene-acrylic copolymer resins, polyester resins and polyol resins is preferably used to impart good electric properties to the resultant toner and decrease production cost thereof. Further, the polyester resins and/or the polyol resins are more preferably used to impart good fixability to the resultant toner.

As mentioned above, the charging member preferably has a coated layer containing at least one selected from linear polyester resin compositions, linear polyol resin compositions, linear styrene-acrylic resin compositions, and crosslinked products thereof.

The above-mentioned colorant component, wax component, charge controlling component etc. are premixed together with the resin component when necessary to prepare a mixture, the mixture is kneaded at a temperature not higher than a melting point of the resin component to prepare a kneaded mixture, and then the kneaded mixture is subjected to cooling, pulverization and classification. In addition, the external additives may be added to the toner when necessary.

EXAMPLES

Hereinafter, Examples relating to the use of an image-bearing member protecting agent according to the present embodiment will be described together with Comparative Examples.

An image forming part of a copier, IMAGIO MP C5000 manufactured by Ricoh Company Ltd., was supplied with an image-bearing member protecting agent according to the present invention from a section for supplying zinc stearate.

The copier, IMAGIO MP C5000 manufactured by Ricoh Company Ltd., employs, in its mechanism for pressing zinc stearate, the technologies disclosed in Patent Literature 3, and the pressing force is substantially constant over time.

A running test was performed to continuously output 50,000 sheets of an A4 size document having an image area ratio of 5% to measure, every 10,000 sheets, a consumption amount of the image-bearing member protecting agent. The consumption amount is determined by dividing the developed part of the weight of the image bearing member (photoconductor) by a driving distance thereof.

In the copier, IMAGIO MP C5000 manufactured by Ricoh Company Ltd., the consumption amount of an image-bearing member protecting agent is desirably 0.1 g/km to 0.3 g/km.

Comparative Example 1

As a fatty acid metal salt was melted, poured in a die, cooled and molded to thereby prepare an image-bearing member protecting agent, which was used in the test. Zinc stearate (produced by NOF CORPORATION) was used for the fatty acid metal salt.

All image-bearing member protecting agents presently used are produced by this method.

Comparative Example 2

As an image-bearing member protecting agent, a fatty acid metal salt was compression-molded so as to be formed in a block, having no orientation on its surface to thereby prepare an image-bearing member protecting agent, which was used in the test. Zinc stearate (produced by NOF CORPORATION) was used for the fatty acid metal salt.

Comparative Example 3

As an image-bearing member protecting agent, a fatty acid metal salt was molded by a compression-molding method so as to form a block having, on its surface, orientation just as in the above-mentioned image-bearing member protecting agent of the present invention, thereby preparing an image-bearing member protecting agent, which was used in the test. Note that a protecting agent-supply brush was pressed against a surface of the image bearing member, perpendicular to the oriented surface thereof. Zinc stearate (produced by NOF CORPORATION) was used for the fatty acid metal salt.

Comparative Example 4

As an image-bearing member protecting agent, a fatty acid metal salt and an inorganic lubricant were mixed at a weight ratio of 8:2, molded by a compression-molding method so as to be formed in a block, having no orientation on its surface to thereby prepare an image-bearing member protecting agent, which was used in the test. Zinc stearate (produced by NOF. CORPORATION) was used for the fatty acid metal salt, and boron nitride (produced by Momentive Performance Materials Inc.) was used for the inorganic lubricant.

Comparative Example 5

As an image-bearing member protecting agent, a fatty acid metal salt and an inorganic lubricant were mixed at a weight ratio of 8:2, molded by a compression-molding method so as to be formed in a block, having, on its surface, orientation just as in the above-mentioned image-bearing member protecting agent of the present invention, thereby preparing an image-bearing member protecting agent, which was used in the test. Note that a protecting agent-supply brush was pressed against a surface of the image bearing member, perpendicular to the oriented surface thereof. Zinc stearate (produced by NOF CORPORATION) was used for the fatty acid metal salt, and boron nitride (produced by Momentive Performance Materials Inc.) was used for the inorganic lubricant.

Example 1

As an image-bearing member protecting agent, a fatty acid metal salt was molded by a compression-molding method so as to form a block having, on its surface, orientation just as in the above-mentioned image-bearing member protecting agent of the present invention, thereby preparing an image-bearing member protecting agent, which was used in the test. Note that a protecting agent-supply brush was pressed against a surface of the image bearing member, parallel to the oriented surfaces thereof. Zinc stearate (produced by NOF CORPORATION) was used for the fatty acid metal salt.

Example 2

As an image-bearing member protecting agent, a fatty acid metal salt and an inorganic lubricant were mixed at a weight ratio of 8:2, molded by a compression-molding method so as to be formed in a block, having, on its surface, orientation just as in the above-mentioned image-bearing member protecting agent of the present invention, thereby preparing an image-bearing member protecting agent, which was used in the test. Note that a protecting agent-supply brush was pressed against a surface of the image bearing member, parallel to the oriented surfaces thereof. Zinc stearate (produced by NOF CORPORATION) was used for the fatty acid metal salt, and boron nitride (produced by Momentive Performance Materials Inc.) was used for the inorganic lubricant.

Figure 14:
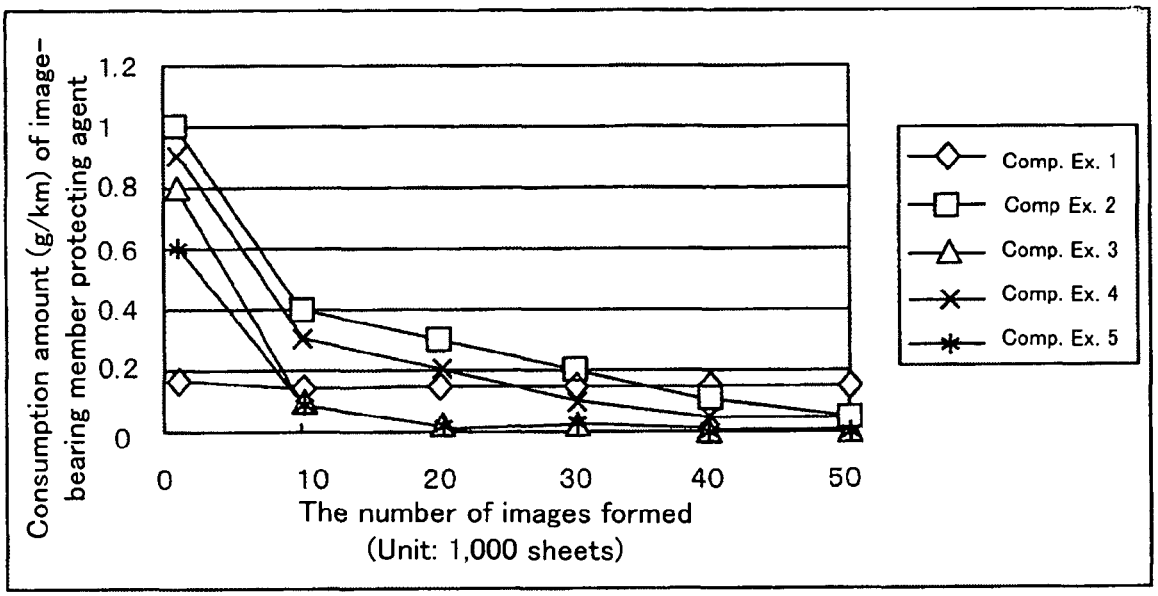
FIG. 14 is a graph of an experimental result showing the relationship between the number of produced images in Comparative Examples and the consumption amount of the image-bearing member protecting agent.
Figure 15:
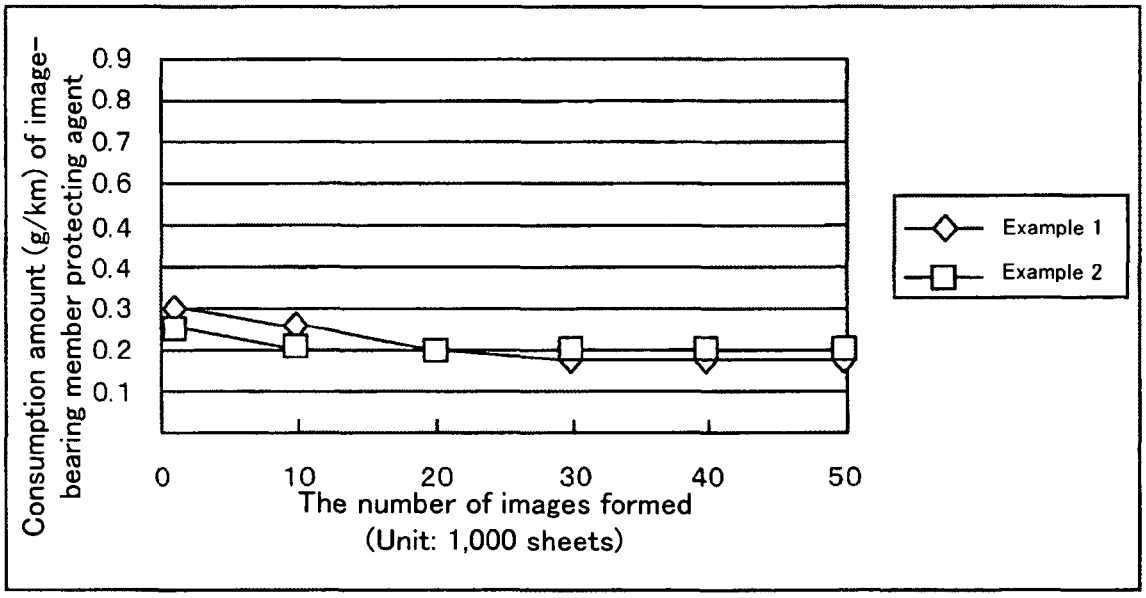
FIG. 15 is a graph of an experimental result showing the relationship between the number of produced images in Examples and the consumption amount of the image-bearing member protecting agent.

The transitive consumption amounts of image-bearing member protecting agents of Comparative Examples are illustrated in FIG. 14. The transitive consumption amounts of image-bearing member protecting agents of Examples according to the present invention are illustrated in FIG. 15.

It is considered that the image-bearing member protecting agents of the present invention can maintain a constant consumption amount over a long period of time because of the following reasons.

An image-bearing member protecting agent is applied to an electrophotographic image bearing member for protecting it from hazards such as deterioration thereof caused by charging and cleaning. Generally, the following method is employed: an image-bearing member protecting agent, which is molded in a block, is scraped by a brush roller to be a powder, and the powder is applied to a surface of an image bearing member. However, brush rollers lose their hardness of brush fibers and lose their force for scraping an image-bearing member protecting agent, when used for a long-term.

However, as described above, when an image-bearing member protecting agent molded by compression-molding so as not to have orientation and an image-bearing member protecting agent molded by compression-molding so as to have orientation on its surface are scraped at their surfaces perpendicular to their oriented surfaces, the consumption amounts thereof decrease over time, as illustrated in FIG. 14. Therefore, these image-bearing member protecting agents cannot maintain their functions.

Then, when an image-bearing member protecting agent (having a block shape) is produced so as to have orientation on its surface and scraped at a surface parallel to the oriented surfaces, it is possible to prevent a reduction in consumption amount thereof over time, as illustrated in FIG. 15.

Figure 16:
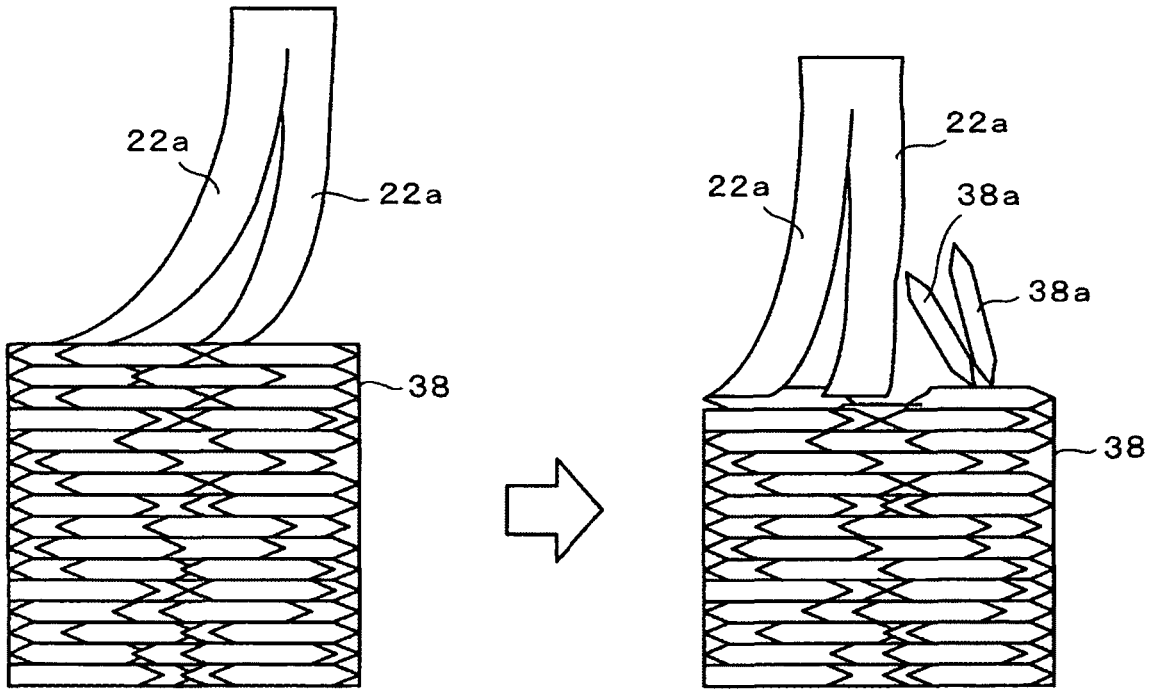
FIG. 16 is a view illustrating how an image-bearing member protecting agent is scraped off when a brush is pressed against a block surface of the image-bearing member protecting agent, substantially parallel to oriented surfaces thereof.
Figure 17:
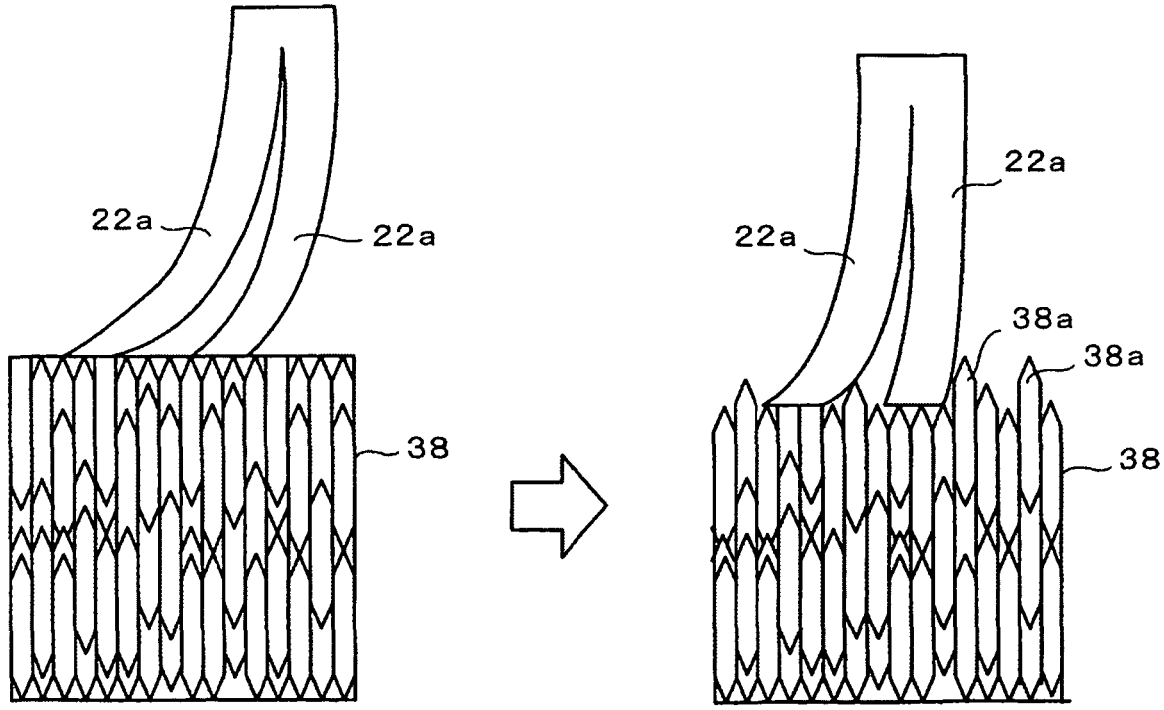
FIG. 17 is a view illustrating how an image-bearing member protecting agent is scraped off when a brush is pressed against a block surface of the image-bearing member protecting agent, perpendicular to an oriented surface thereof.

Factors of preventing a reduction in consumption amount of image-bearing member protecting agents in Examples are illustrated in FIGS. 16 and 17.

As illustrated in FIG. 16 when an image-bearing member protecting agent is scraped at its surface parallel to the oriented surfaces thereof by a brush, the protecting agent is scraped so as to be peeled off along the oriented surfaces thereof, and thus an excessive amount of load is not applied to the brush, thereby making it possible to prevent permanent strain of the brush.

Meanwhile, as illustrated in FIG. 17, when an image-bearing member protecting agent is scraped at its surface perpendicular to the oriented surfaces thereof, it cannot be scraped without a strongly combined part being broken up. Therefore, it is necessary to press the protective agent block with strong power, which accelerates permanent strain of the brush. Similarly, in use of an image-bearing member protective agent having no orientation on its surface, molecules in the block are complicatedly combined to each other, and thus strong power is necessary for scraping with a brush.

Table 1 shows result of contamination of the charging member and the contamination degree of the photoconductor used at the point of image-forming 50,000 sheets, using the image-bearing member protecting agents of Comparative Example 1 and Examples 1 and 2.

TABLE 1

| | Contamination on charging member | Protectiveness of photoconductor |
|---|---|---|
| Comparative Example 1 | D | B |
| Example 1 | B | A |
| Example 2 | A | A |

Criteria of contamination on charging member:

A: Almost no contamination was observed on the charging member.

B: A small amount of contaminant was observed on the charging member, but there was no adverse effect on images formed at an ordinary temperature.

C: Contaminants were observed at an early stage of the image forming process.

D: Abnormal images appeared at an early stage of the image forming process.

Criteria of protectiveness of photoconductor:

A: Almost no abrasion/filming was observed on the photoconductor.

B: Filming was slightly observed, but there was no problem in practical use.

C: Abnormal images appeared over time.

D: Abnormal images appeared at an early stage of the image forming process.

As evident from the comparison of Example 1 with Example 2, it is preferred to use boron nitride as a component of an image-bearing member protecting agent, because the effect of prevention contamination of a charging member is more improved.

What is claimed is:

1. An image-bearing member protecting agent, which has a block shape and is used in an image forming process where the image-bearing member protecting agent is applied or attached to a surface of an image bearing member while being scraped off with a roll-shaped brush, the image-bearing member protecting agent comprising:

a fatty acid metal salt, wherein the image-bearing member protecting agent includes a plurality of small blocks and has such an orientation that one or more of the small blocks are easily separated from other small blocks, and a plurality of oriented surfaces of the plurality of small blocks are arranged in a laminated state in a substantially same direction.

2. The image-bearing member protecting agent according to claim 1, wherein the image-bearing member protecting agent is formed by compression molding a particulate or granular raw material, which contains the fatty acid metal salt, in a mold, and the raw material is compressed while air contained in the raw material being pressed out in a lateral direction, so that the plurality of oriented surfaces are formed.

3. The image-bearing member protecting agent according to claim 1, further comprising an inorganic lubricant.

4. The image-bearing member protecting agent according to claim 1, wherein opposite surfaces of the small blocks are substantially parallel to one another and substantially parallel to a direction of orientation of the small blocks.

5. The image-bearing member protecting agent according to claim 4, wherein the direction of orientation is parallel to a direction of movement of brush bristles across a block surface of the image-bearing member protecting agent.

6. A protective layer forming device comprising:

a roll-shaped brush, wherein the protective layer forming device is configured to apply or attach an image-bearing member protecting agent to a surface of an image bearing member, the image-bearing member protecting agent being scraped off with the roll-shaped brush, wherein the image-bearing member protecting agent includes a plurality of small blocks and has such an orientation that one or more of the small blocks are easily separated from other small blocks, and a plurality of oriented surfaces of the plurality of small blocks are arranged in a laminated state in a substantially same direction, and wherein the brush is pressed against a block surface of the image-bearing member protecting agent, the block surface being substantially parallel to the oriented surfaces of the image-bearing member protecting agent.

7. The protective layer forming device according to claim 6, further comprising a layer forming member for pressing the image-bearing member protecting agent supplied to the surface of the image bearing member to form a film.

8. The protective layer forming device according to claim 6, wherein opposite surfaces of the small blocks are substantially parallel to one another and substantially parallel to a direction of orientation of the small blocks.

9. An image forming apparatus comprising:

an image bearing member which undergoes a process for bearing a toner image, a transfer device configured to transfer the toner image formed on a surface of the image bearing member onto a transfer medium, and a protective layer forming device comprises a roll-shaped brush and is configured to apply or attach an image-bearing member protecting agent to the surface of the image bearing member from which the toner image has been transferred onto the transfer medium, the image-bearing member protecting agent being scraped off with the roll-shaped brush, wherein the image-bearing member protecting agent includes a plurality of small blocks and has such an orientation that one or more of the small blocks are easily separated from other small blocks, and a plurality of oriented surfaces of the plurality of small blocks are arranged in a laminated state in a substantially same direction, and wherein the brush is pressed against a block surface of the image-bearing member protecting agent, the block surface being substantially parallel to the oriented surfaces of the image-bearing member protecting agent.

10. The image forming apparatus according to claim 9, further comprising a cleaning device, wherein the cleaning device is placed downstream the transfer device and upstream the protective layer forming device along a rotational direction of the image bearing member and is configured to remove a toner remaining on the surface of the image bearing member by rubbing the surface of the image bearing member.

11. The image forming apparatus according to claim 9, wherein the image bearing member contains a thermosetting resin in at least an uppermost surface layer thereof.

12. The image forming apparatus according to claim 9, wherein the image bearing member is a photoconductor.

13. The image forming apparatus according to claim 9, further comprising a charging device which is provided in contact with or close to the surface of the image bearing member.

14. The image forming apparatus according to claim 9, wherein the image bearing member is an intermediate transfer medium.

15. The image forming apparatus according to claim 9, wherein the toner has a circularity SR, which is represented by Equation 1, of 0.93 to 1.00:

Circularity *SR*=(periphery of a circle having the same area as a particle projection area)/(periphery of a particle projection image) Equation 1

16. The image forming apparatus according to claim 9, wherein a ratio (D4/D1) of a weight average particle diameter (D4) of the toner to a number average particle diameter (D1) thereof is 1.00 to 1.40.

17. The image forming apparatus according to claim 9, wherein opposite surfaces of the small blocks are substantially parallel to one another and substantially parallel to a direction of orientation of the small blocks.

* * * * *